US007662452B2

(12) United States Patent
Nagashima et al.

(10) Patent No.: US 7,662,452 B2
(45) Date of Patent: Feb. 16, 2010

(54) INK RECORDING MEDIUM AND PRODUCTION METHOD THEREFOR

(75) Inventors: Hitoshi Nagashima, Kanagawa (JP); Tsuyoshi Santo, Kanagawa (JP); Motoaki Sato, Tokyo (JP); Hiroshi Asakawa, Kanagawa (JP); Muneyoshi Sunada, Tokyo (JP); Satoko Kakumoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 10/909,281

(22) Filed: Aug. 3, 2004

(65) Prior Publication Data

US 2005/0058786 A1 Mar. 17, 2005

(30) Foreign Application Priority Data

Aug. 4, 2003 (JP) ..... 2003-286265
Jul. 29, 2004 (JP) ..... 2004-222488

(51) Int. Cl.
*B41M 5/50* (2006.01)

(52) U.S. Cl. ..... 428/32.26; 427/146

(58) Field of Classification Search ..... None
See application file for complete search history.

(56) References Cited

U.S. PATENT DOCUMENTS 4,202,870 A 5/1980 Weber et al. ..... 423/630
4,242,271 A 12/1980 Weber et al. ..... 260/448
4,248,852 A 2/1981 Wakabayashi et al. ..... 423/626
4,886,775 A 12/1989 Kubodera et al. ..... 503/227
5,635,291 A 6/1997 Yoshino et al. ..... 428/304.4
5,800,916 A 9/1998 Yoshino et al. ..... 428/328
5,846,647 A 12/1998 Yoshino et al. ..... 428/328
5,851,654 A 12/1998 Yoshino et al. ..... 428/328
5,869,177 A 2/1999 Yoshino et al. ..... 428/328
5,882,388 A 3/1999 Adair et al. ..... 106/31.6
5,955,185 A 9/1999 Yoshino et al. ..... 428/304.4
5,962,124 A 10/1999 Yoshino et al. ..... 428/328
5,965,252 A 10/1999 Santo et al. ..... 428/329
6,342,289 B1 1/2002 Eguchi et al. ..... 428/195

(Continued)

FOREIGN PATENT DOCUMENTS

AU 706957 B2 10/1996

(Continued)

OTHER PUBLICATIONS

Brunauer, Stephen, et al., "Adsorption of Gases in Multimolecular Layers," Journal of the American Chemical Society, vol. LX, pp. 309-319 (1938).

(Continued)

*Primary Examiner*—Bruce H Hess
(74) *Attorney, Agent, or Firm*—Fitzpatrick, Cella, Harper & Scinto

(57) ABSTRACT

The invention provides a recording medium providing an image storage property over a prolonged period and satisfactory recording properties at the same time, and a producing method for securely realizing such characteristics. In incorporating a colorant deterioration preventing agent in an ink-receiving layer, the colorant deterioration preventing agent is dissolved in a solvent and is applied on the ink-receiving layer thereby forming a high concentration region containing the colorant deterioration preventing agent at a high concentration and a low concentration region containing the colorant deterioration preventing agent at a low concentration, with the high concentration region positioned closer to the recording surface.

13 Claims, 7 Drawing Sheets

U.S. PATENT DOCUMENTS

| | | | | |
|---|---|---|---|---|
| 6,406,775 | B1 | 6/2002 | Houde | 428/195 |
| 6,420,016 | B1 | 7/2002 | Peternell et al. | 428/195 |
| 6,500,525 | B1 | 12/2002 | Ogino et al. | 428/195 |
| 6,558,740 | B1 | 5/2003 | Santo et al. | 427/146 |
| 6,565,950 | B1 | 5/2003 | Tomioka et al. | 428/195 |
| 6,596,378 | B2 | 7/2003 | Hanmura et al. | 428/195 |
| 6,649,661 | B2 | 11/2003 | Yoshino et al. | 516/33 |
| 6,670,037 | B1 | 12/2003 | Okura et al. | 428/402 |
| 6,685,999 | B2 | 2/2004 | Ichinose et al. | 428/32.25 |
| 6,689,432 | B2 * | 2/2004 | Kitamura et al. | 428/32.37 |
| 2001/0055055 | A1 | 12/2001 | Eguchi et al. | 347/105 |
| 2002/0012629 | A1 | 1/2002 | Yoshino et al. | 423/625 |
| 2002/0097309 | A1 * | 7/2002 | Hiro et al. | 347/101 |
| 2004/0048008 | A1 | 3/2004 | Yoshino et al. | 428/32.1 |
| 2004/0058098 | A1 * | 3/2004 | Kondo et al. | 428/32.1 |
| 2004/0066446 | A1 | 4/2004 | Yamaguchi et al. | 347/105 |
| 2004/0135864 | A1 | 7/2004 | Ogino et al. | 347/100 |

FOREIGN PATENT DOCUMENTS

| | | | |
|---|---|---|---|
| EP | 0 422 668 | A2 | 4/1991 |
| EP | 0 514 633 | A1 | 11/1992 |
| EP | 1 273 455 | A1 | 1/2003 |
| EP | 1 352 755 | A2 | 10/2003 |
| EP | 1 365 283 | A1 | 11/2003 |
| JP | 57-44605 | | 3/1982 |
| JP | 61-146591 | | 7/1986 |
| JP | 63-236684 | | 10/1988 |
| JP | 3-13376 | A | 1/1991 |
| JP | 4-34512 | B2 | 6/1992 |
| JP | 7-232473 | A | 9/1995 |
| JP | 7-232475 | A | 9/1995 |
| JP | 8-132731 | A | 5/1996 |
| JP | 9-66664 | A | 3/1997 |
| JP | 9-76628 | A | 3/1997 |
| JP | 2000-211246 | A | 8/2000 |
| JP | 2001-10214 | A | 1/2001 |
| JP | 2001-162928 | A | 6/2001 |
| JP | 2002-046349 | | 2/2002 |
| JP | 2003-191633 | | 7/2003 |

OTHER PUBLICATIONS

Barrett, Elliott P., et al., "The Determination of Pore Volume and Area Distributions in Porous Substances. I. Computations from Nitrogen Isotherms," Journal of the American Chemical Society, vol. LXXIII, pp. 373-380 (1951).

* cited by examiner

WITH HINDERED AMINE

WITHOUT HINDERED AMINE

INK RECORDING MEDIUM AND PRODUCTION METHOD THEREFOR

This application claims priority from Japanese Patent Application No. 2003-286265, filed Aug. 4, 2003, and Japanese Patent Application No. 2004-222488, filed Jul. 29, 2004, both of which are hereby incorporated by reference herein.

BACKGROUND OF THE INVENTION

1. Field of the Invention

The present invention relates to a recording medium adapted for use in recording with an aqueous ink and a producing method therefore, and more particularly to an ink recording medium having an image storage property over a prolonged period and a method for producing an ink recording medium capable of securely realizing such characteristics.

2. Related Background Art

The ink jet recording method is to record an image or a character by causing a small droplet of a recording liquid such as an ink to fly by various operating principles and to adhere on a recording medium such as paper, and has features of high-speed, low noise, easy formation of a color image, wide adaptability to various recording patterns and absence of an image development step, thus becoming rapidly popular not only in a printer but also as an output unit for information equipment such as a copying machine, a word processor, a facsimile, and a plotter. Also a digital camera, a digital video camera, a scanner etc. of a high performance are recently made available inexpensively, and, in combination with the pervasiveness of personal computers, printers utilizing the ink jet recording method are becoming very advantageously employed for outputting image information obtained from such instruments. Based on such background, it is being required to output an image comparable in quality to a silver halide photograph or a lithographic multi-color printing, handily by the ink jet recording method.

In order to meet such requirement, improvements on the structure of the printer itself and the recording method are being made to achieve higher recording speed, higher definition, full-color image formation etc., and improvements are also being made on the structure and the characteristics of the recording media.

The recording medium employed in the ink jet recording has conventionally been proposed in various forms. A recording medium, comparable in quality to the silver halide photograph, requires an image formation with an excellent color developing property of dyes, high surface glossiness, high image resolving ability, etc. As a material for constituting an ink-receiving layer of a recording medium capable of providing an image comparable to a silver halide photograph, there can be employed for example alumina hydrate which is described for example in Japanese Patent Application Laid-open No. H07-232475.

Also a storage property is recently required for the recorded image. There is proposed a method of improving the storage property of the recorded image by including a colorant deterioration preventing agent in order to improve light fastness and gas resistance.

For example, in order to resolve a migration phenomenon in which a colorant in the recorded image migrates depending on temperature or humidity to cause a bleeding of the image, there is proposed a recording sheet containing a cationic compound. Also for improving the storage property of the image against light, Japanese Patent Publication No. 4-34512 proposes a recording medium in which a hindered amine compound is added in the form of an acid salt in a coating liquid (for forming an ink-jet recording paper), and Japanese Patent Application Laid-open No. H03-13376 discloses a recording medium coated with a hindered amine and a hindered phenol dissolved in an organic solvent. The recording medium containing such colorant deterioration preventing agent shows an effect to a certain degree in the gas resistance or the light fastness, but is often unsatisfactory on the image storage property over a prolonged period.

The prior art level is described in Japanese Patent Application Laid-open No. 2001-162928. According to the description therein, for an ink-receiving layer of a thickness of 35 μm provided on a film, an upper portion of 5 μm (a portion between the surface and 5 μm deep) and a lower portion of 5 μm (a portion between the interface to the film and upper 5 μm thick from the interface) thereof are crushed, and amounts of nitric acid group contained therein are compared. Result of comparison shows that the amount of the nitric acid group is smaller in the lower 5 μm than in the upper 5 μm, but the effect is limited to a "light fastness" obtained by the presence of the nitric acid group. Stated differently the effect is limited to an effectiveness in comparison to a comparative example which is completely free from the nitric acid groups. Besides, this reference describes applying a large amount of a coating liquid on a recording medium, but does not teach how the material that supplies the nitric acid group is absorbed in the ink-receiving layer or how the drying of the ink-receiving layer after application of the coating liquid is conducted. In addition, the reference does not disclose even a detecting method for the nitric acid group, so that even a repeated test is not possible. In particular, the distribution condition of the nitric acid group in the ink-receiving layer region between the upper portion of 5 μm and the lower portion of 5 μm is not known at all.

Also, Japanese Patent Application Laid-open No. 2000-211246 discloses a recording medium in which aluminum nitrate is internally added and homogeneously dispersed. Japanese Patent Application Laid-open No. 2000-211246 describes that a recording medium containing aluminum nitrate is excellent in light fastness. In the comparison of the light fastness described in Japanese Patent Application Laid-open Nos. 2001-162928 and 2000-211246, though a direct comparison is difficult due to a difference in the test methods, since the light fastness in the comparative example of Japanese Patent Application Laid-open No. 2001-162928 is an acceptable level in Japanese Patent Application Laid-open No. 2000-211246. it is estimated that the example shown in Japanese Patent Application Laid-open No. 2001-162928 has a light fastness weaker than that of the recording medium of Japanese Patent Application Laid-open No. 2000-211246 in which aluminum nitrate is internally added and uniformly dispersed. This fact supports an assumption that the aforementioned 25 μm intermediate range is uniform.

On the other hand, Japanese Patent Application Laid-open No. 2001-010214 discloses an ink-receiving layer of three-layered structure containing a specified nitrogen compound uniformly and formed by applying coating liquids respectively containing silica, polyvinyl alcohol and boric acid by 70 μm each.

SUMMARY OF THE INVENTION

The present invention was intended to resolve a technical problem of how to achieve effective utilization of a colorant deterioration preventing agent (preferably a gas deterioration preventing agent such as a hindered amine for principally preventing destruction of a colorant by a gas, including ozone). A type in which the colorant deterioration preventing agent is mixed in advance in a coating liquid merely provides a uniform distribution as shown in FIGS. 1A and 1B, so that a large amount of the colorant deterioration preventing agent, if used for obtaining desired characteristics, causes a new problem of a decrease in the ink absorbing property. On the other hand, the amount of the colorant deterioration preventing agent has to be reduced in order to increase the ink absorbing property. Also, if the substrate for the recording medium is an absorbent substrate, the externally added colorant deterioration preventing agent penetrates even to the substrate, as shown in FIGS. 2A and 2B, thus not providing an effect corresponding to the externally added amount, and is therefore wasted. Thus, a sufficient effect could not be obtained through external addition, either.

Therefore, the present inventors have made intensive investigations for obtaining an ink-receiving layer providing a higher effect with respect to the used amount of the colorant deterioration preventing agent and also having an excellent ink absorbing property. It was thus found, in studying behavior of a coating liquid containing ink and a colorant deterioration preventing agent in the direction of depth from the recording surface of the ink-receiving layer, in view of penetration and diffusion of the ink itself and diffused distribution of the colorant that the colorant is present within a range of 30 μm from the recording surface and more importantly has a distribution within a range of 20 μm. It was thus found important for improving the efficiency that the colorant deterioration preventing agent is present corresponding to such colorant distribution. In addition it was also found important that the distribution of the colorant deterioration preventing agent in the ink-receiving layer does not impair ink absorbency, and that desired colorant deterioration preventing effect is achieved with an amount as small as possible.

Therefore, the present invention has a first object of providing an ink-receiving layer capable of exhibiting a far larger effect than in the past with the colorant deterioration preventing agent of a given amount (preferably an ink-receiving layer in which the colorant deterioration preventing agent is concentrated at the recording surface), also has a second object of providing an ink-receiving layer capable of attaining an efficient utilization of the colorant deterioration preventing agent and a satisfactory ink absorbing property at the same time, and a third object of how to produce an ink-receiving layer meeting the first or second object.

In a first aspect of the present invention, there is provided an ink recording medium provided with an ink-receiving layer containing a pigment for holding a colorant of an ink, a binder for the pigment and a colorant deterioration preventing agent, characterized in that the ink-receiving layer includes, within a range of 30 μm in a direction of depth from a recording surface of the ink-receiving layer, a high concentration portion in which the colorant deterioration preventing agent has a relatively higher concentration and a low concentration portion in which the colorant deterioration preventing agent has a relatively lower concentration, and that the high concentration portion is positioned closer to the recording surface than the low concentration portion.

In a second aspect of the present invention, there is provided an ink recording medium having the structural feature of the first aspect and an additional feature in which at least the colorant deterioration preventing agent has a concentration distribution decreasing in a direction of depth from the recording surface, within a range of 15 μm in the direction of depth from the recording surface of the ink-receiving layer.

In a third aspect of the present invention, there is provided an ink recording medium having the structural feature of the first aspect and an additional feature in which at least the colorant deterioration preventing agent has a concentration distribution decreasing in a direction of depth from the recording surface, within a range of 10 μm in the direction of depth from the recording surface of the ink-receiving layer.

In a fourth aspect of the present invention, there is provided an ink recording medium having the structural feature of the first aspect and an additional feature in which at least the colorant deterioration preventing agent has a concentration distribution decreasing in a direction of depth from the recording surface, within an arbitrarily selected range of 5 μm in the direction of depth of the ink-receiving layer.

In a fifth aspect of the present invention, there is provided a method for producing an ink recording medium provided with an ink-receiving layer containing a pigment for holding a colorant of an ink, a binder for the pigment and a colorant deterioration preventing agent, characterized by forming an ink-receiving layer including, within a range of 30 μm in a direction of depth from a recording surface of the ink-receiving layer, a high concentration portion in which the colorant deterioration preventing agent has a relatively higher concentration and a low concentration portion in which the colorant deterioration preventing agent has a relatively lower concentration, and that the high concentration portion is positioned closer to the recording surface than the low concentration portion.

In a sixth aspect of the present invention, there is provided a method for producing an ink recording medium provided with an ink-receiving layer containing a pigment for supporting a colorant of an ink, a binder for the pigment and a colorant deterioration preventing agent, characterized by including a step of forming a wet surface containing a crosslinking agent for crosslinking the binder, a step of applying a coating liquid containing the colorant deterioration preventing agent, and a step of drying in continuation to the application step thereby forming a distribution of the colorant deterioration preventing agent.

The first aspect of the present invention allows to provide an ink-receiving layer capable of exhibiting a far larger effect than in the past with the colorant deterioration preventing agent of a given amount and an ink-receiving layer capable of attaining an efficient utilization of the colorant deterioration preventing agent and a satisfactory ink absorbing property at the same time. The second aspect of the present invention provides a distribution closer to the recording surface, thereby improving the absorbing efficiency and further enhancing the effect of the colorant deterioration preventing agent. Also the third aspect of the present invention, forming a substantially steeper distribution, can attain an ideal distribution of the colorant deterioration preventing agent. The effect is even superior to the condition of the second aspect. The fourth aspect of the present invention similarly provides an ideal state, thereby securely attaining effects explained in the following examples. Also the fifth and sixth aspects of the present invention allow to securely produce the ink-receiving layer of the first to fourth aspects.

DETAILED DESCRIPTION OF THE PREFERRED EMBODIMENTS

Figure 1A:
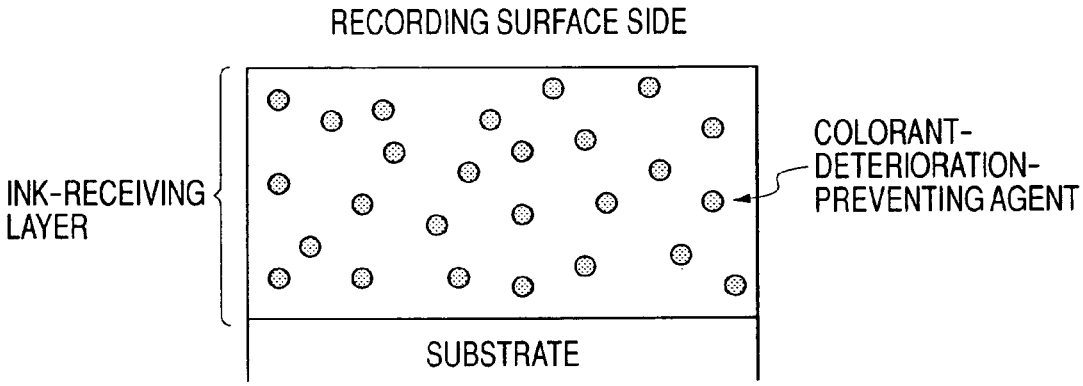
FIGS. 1A and 1B are views showing an example of a problem in the prior art.
Figure 1B:
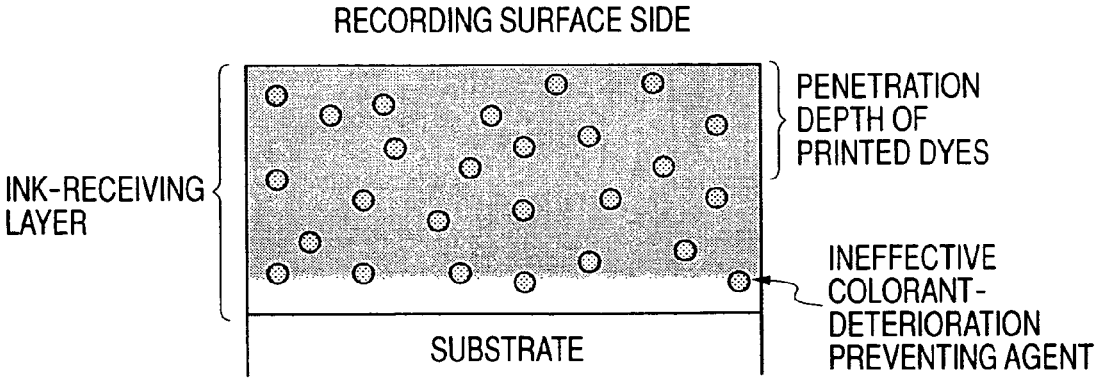
Figure 2A:
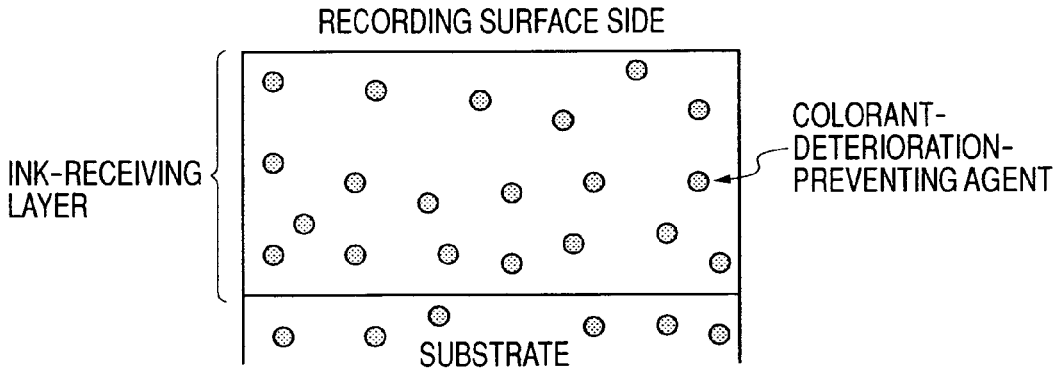
FIGS. 2A and 2B are views showing an example of a problem in the prior art.
Figure 2B:
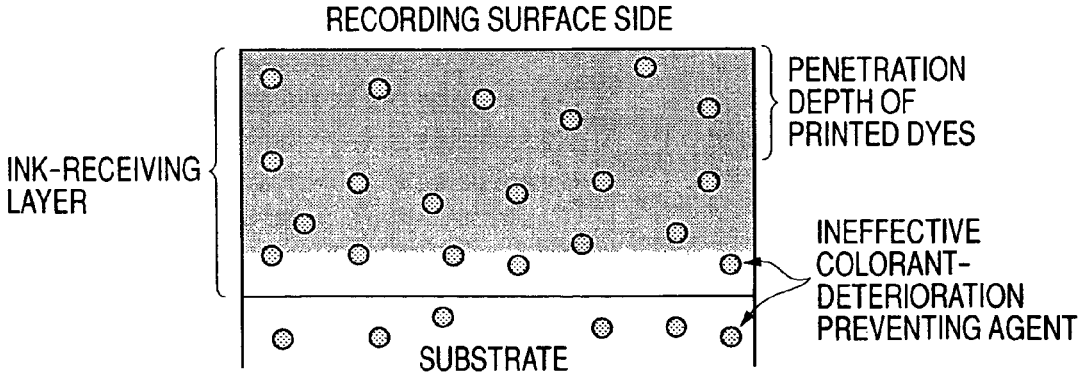
Figure 3A:
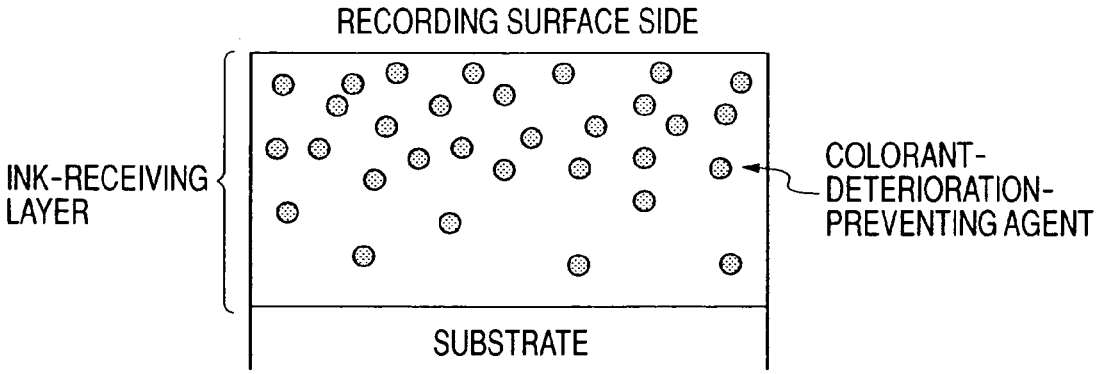
FIGS. 3A and 3B are views showing an example of the present invention.
Figure 3B:
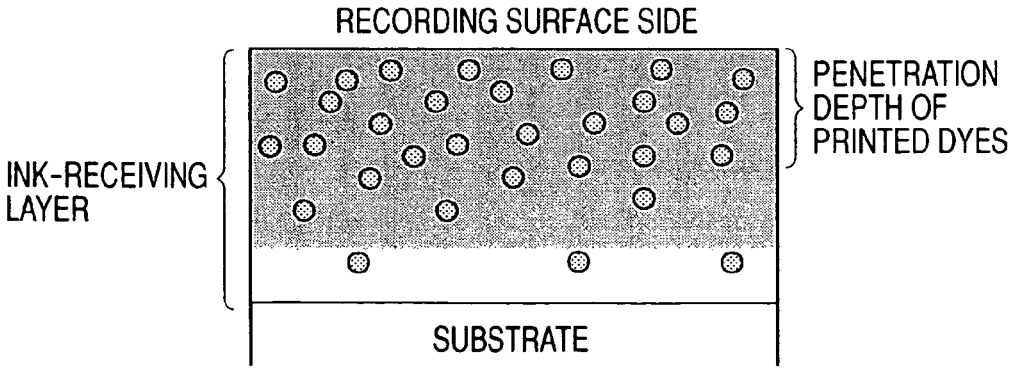

The present invention can attain an image storage property over a prolonged period by a configuration in which, in the ink-receiving layer, the colorant deterioration preventing agent (preferably a gas deterioration preventing agent such as a hindered amine for principally preventing destruction of a colorant by a gas including ozone) is not uniformly distributed, but the ink-receiving layer includes, within a range of 30 μm in a direction of depth from a recording surface of the ink-receiving layer, a high concentration portion in which the colorant deterioration preventing agent has a relatively higher concentration and a low concentration portion in which the colorant deterioration preventing agent has a relatively lower concentration, and in which the high concentration portion is positioned closer to the recording surface than the low concentration portion. When the colorant deterioration preventing agent is present, within the ink-receiving layer, in a larger amount at the side of the recording surface thereof as shown in FIGS. 3A and 3B, and when the ink is printed on such recording medium, the effect of the colorant deterioration preventing agent can be fully exploited in comparison with a case where the colorant deterioration preventing agent is uniformly distributed within the ink-receiving layer, as the colorant deterioration preventing agent is present in a large amount in the vicinity of the dye. Also, when the dye is present in a position deeper than 30 μm in the direction of depth from the recording surface of the ink-receiving layer, such dye rarely affects the image properties, such as hue or optical density. Therefore, the colorant deterioration preventing agent preferably has a concentration distribution within a range of 30 μm in the direction of depth from the recording surface of the ink-receiving layer.

Particularly in the case where the colorant deterioration preventing agent has, within a range of 15 μm in the direction of depth from the recording surface of the ink-receiving layer, a distribution of concentration decreasing in the direction of depth, the colorant deterioration preventing agent is present in such an amount as to match the penetration of the dye, and can therefore be more effective. In the present invention, therefore, it is important that the concentration be distributed in the vicinity of the recording surface, namely in an upper layer portion as seen from the side of the recording surface of the ink-receiving layer.

The distribution of concentration of the colorant deterioration preventing agent was measured in the following manner. A cross section of the ink recording medium was subjected to a line analysis by FT-IR microscopic transmissive measurement, and an absorbance of a single or plural absorption wavelengths capable of identifying the colorant deterioration preventing agent was measured at each depth of 1 μm, as will be explained later. The distribution of the concentration was determined from the change in the obtained absorbance.

The ink recording medium of the present invention can be produced by the following producing method. At first an ink-receiving layer containing at least a pigment for holding the colorant of the ink and a binder for the pigment is formed in such a manner that the binder is crosslinked progressively in the direction of depth from the recording surface, and then a colorant deterioration preventing agent is applied on such ink-receiving layer and immediately dried to obtain an ink recording medium having such a distribution of concentration that the colorant deterioration preventing agent is present in a larger amount at the side of the recording surface of the ink-receiving layer. The reason for formation of such concentration distribution has not been made clear, but is estimated by the present inventors as follows.

When a coating liquid including a colorant deterioration preventing agent is applied on a recording medium having a binder layer in which the binder is crosslinked progressively in the direction of depth from the recording surface of the ink-receiving layer, the colorant deterioration preventing agent is stopped, with penetrating in the direction of depth while being contained in the solvent of the coating liquid by the progressively crosslinked binder, thus being prevented from penetration to the substrate side of the ink-receiving layer but remaining inside the ink-receiving layer. By rapidly drying the solvent for the colorant deterioration preventing agent before the penetration of the colorant deterioration preventing agent is completed, the colorant deterioration preventing agent is pulled up toward the recording surface together with the evaporating solvent, thus gathering at the side of the recording surface. It is estimated that the distribution of concentration, larger at the side of the recording surface of the ink-receiving layer, can be formed in this manner. Therefore, in attaining the objects of the present invention, important are the following two points, firstly to control penetration of the colorant deterioration preventing agent by crosslinking of the binder, and secondly, after the application of the colorant deterioration preventing agent, to start a drying step within a short time in which the penetration of the colorant deterioration preventing agent is not completed.

Figure 4:
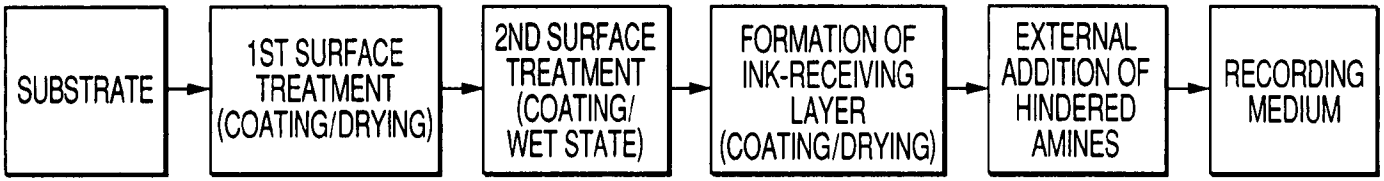
FIG. 4 is a view showing a process flow of an example of the production method for an ink recording medium of the present invention.
Figure 5:
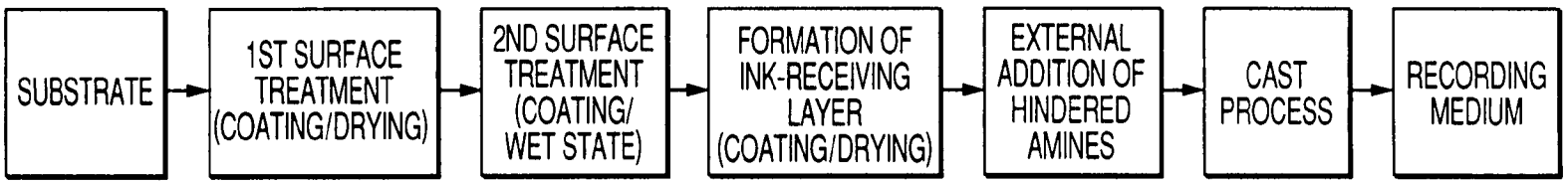
FIG. 5 is a view showing a process flow of an example of the production method for an ink recording medium of the present invention.
Figure 6:
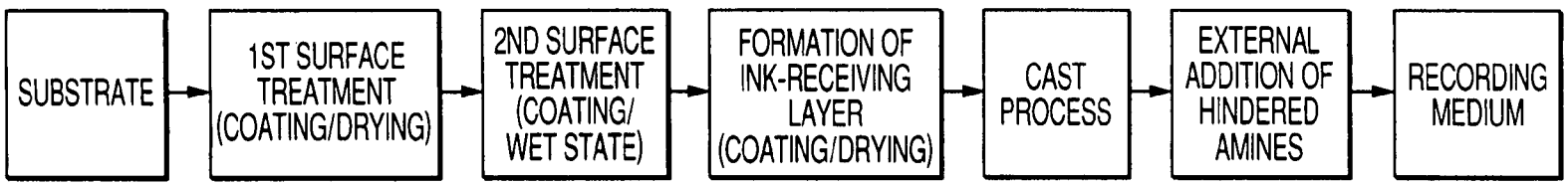
FIG. 6 is a view showing a process flow of an example of the production method for an ink recording medium of the present invention.

Hereinafter, the present invention will be described in more detail based on preferred embodiments. Preferable manufacturing processes for a recording medium of the present invention are generally classified into three types shown in FIGS. 4, 5 and 6. One of the types is shown in FIG. 4 in which the process includes five steps of surface-treatment, a step of forming an ink-receiving layer, and a step for external addition of a colorant deterioration preventing agent. On the other hand, other types are shown in FIGS. 5 and 6, in which the method of manufacturing a recording medium further includes a step of casting for providing a glossy surface, and the step for external addition of the colorant deterioration preventing agent may be executed before or after the casting. In consideration of the appearance of the recording medium after the finishing step, the colorant deterioration preventing agent is preferably externally added before the casting, and, depending upon the type of the colorant deterioration preventing agent, the effect of the colorant deterioration preventing agent may be deteriorated by the casting step, it is more preferable that the casting step is absent.

A preferable embodiment of the method of manufacturing a recording medium of the present invention will be described at first. The manufacturing method of the present invention shows an excellent productivity while attaining stable characteristics thereof as an appropriate aggregation action of a pigment and an appropriate binding action of a binder are surely obtained at a liquid-to-liquid contact interface while making good use of the conditions of a coating liquid at such an interface and the loss of a binder which should remain in the ink-receiving layer is avoided. The recording medium of the present invention has a novel configuration which can be obtained as a result of securing the binder which should be in the ink-receiving layer. Thus, in a preferred embodiment of the present invention, the ink-receiving layer includes a first layer region in which the binder is made uniform relative to the pigment and a second layer region in which the binder is cross-linked such that the degree of crosslinking becomes larger than that of the first layer region due to the second crosslinking agent to achieve the recording medium in which the first layer region is formed closer to the ink recording surface side than the second layer region.

The recording medium of the present invention can be obtained by applying and immediately drying a coating liquid containing the colorant deterioration preventing agent.

The ink-receiving layer of the ink recording medium includes a first layer region in which the binder is crosslinked with a first crosslinking agent and made uniform relative to the pigment and a second layer region in which the binder is cross-linked with a second crosslinking agent such that the degree of crosslinking becomes larger than that of the first layer region wherein the first layer region is formed closer to the ink recording surface side than the second layer region.

The aforementioned crosslinking degree can be judged as a difference or a ratio in quantity (for example twice or larger) of a common element contained in the first and second crosslinking agents and included respectively in the first and second layer regions. As a specific example of the material and the producing method, a coating liquid formed by dissolving and mixing an alumina hydrate as the aforementioned pigment, polyvinyl alcohol as the binder and orthoboric acid as the first crosslinking agent is applied on a wet surface of a substrate containing a tetraborate salt as the second crosslinking agent for forming the second layer region thereby forming the ink recording medium. Also in a practical example, the content of orthoboric acid per unit area is less than the content of sodium tetraborate: contained in the wet surface per unit area. It is more preferable that the pigment is an alumina hydrate, the binder is polyvinyl alcohol and the first and second crosslinking agents commonly contain boron "B" wherein the amount of boron B contained in the second layer region is twice or more of the amount of boron B contained in the first layer region.

In a manufacturing method for the ink recording medium having such ink-receiving layer, it is preferable, after a surface treatment with the second crosslinking agent on the substrate, to form a certain wet state (also a liquid coated state or a viscosity increased state) on the substrate surface, and to apply a coating liquid containing the first crosslinking agent for forming a next ink-receiving layer while such state is maintained. A coating liquid to be used in the process of the surface treatment preferably has a dry-coating amount, for example, in a range of 0.05 $g/m^2$ or more and 2.0 $g/m^2$ or less, which is expressed in terms of the solid content. If the dry-coating amount of the coating liquid is less than the above range, the viscosity of the coating liquid becomes too low, resulting in the flow of a large amount of the liquid. On the other hand, if it is higher than the above range, spot-like surface (cast surface) defects tend to occur in the casting step, so that a uniform and excellent glossy surface may be hardly obtained. The application of the coating liquid in a state where the substrate surface is maintained in a certain wet state secures a liquid-to-liquid interfacial reaction state between the coating liquid and the second crosslinking agent. Thus, the gelling speed or the crosslinking speed of the coating liquid for the ink-receiving layer becomes faster at such interface, thereby effectively forming an ink-receiving layer including the first layer region in which the binder is crosslinked with the first crosslinking agent and made uniform relative to the pigment and the second layer region in which the binder is cross-linked with the second crosslinking agent such that the degree of crosslinking becomes larger than that of the first layer region wherein the first layer region is formed closer to the ink recording surface side than the second layer region.

It is also possible to apply the first and second surface treatments with the second crosslinking agent stepwise on the substrate. A coating liquid to be used in the process of the surface treatment preferably has, for the aforementioned reason, a dry-coating amount, for example, in a range of 0.05 $g/m^2$ or more and 2.0 $g/m^2$ or less, which is expressed in terms of the solid content. In the process of the first surface treatment, in case the binder is for example polyvinyl alcohol, the coating liquid may be one that contains at least one selected from the group of boric acid and borate, for example an aqueous solution of 5 mass % borax, which is applied on an undercoating layer of the substrate and is then dried to be solidified. Furthermore, if required, a solvent such as alcohol may be included in the coating liquid for debubbling. It is preferable that the dry-coating amount of the coating liquid is as small as possible in the first surface treatment step, so that the rates of the respective steps of coating and drying can be substantially increased, for example, high speed processing at a rate of 50 to 200 meters per minute can be attained.

In the process of the second surface treatment performed after the first surface treatment, as in the case of the first process, an additional coating liquid containing, when the binder is, for example, polyvinyl alcohol, at least one selected from the group consisting of boric acid and borate is applied on the substrate on which the surface treatment has been made by the first surface treatment. In the second surface treatment, in contrast with the first surface treatment, the coating liquid is not dried and solidified after the coating. In other words, the surface of the substrate keeps a wet state of some degree (or liquid coated state or viscosity increased state). While such state is maintained, a coating liquid is further applied for a subsequent formation of an ink-receiving layer. In this manner, a liquid-to-liquid interfacial reaction state is secured between the coating liquid and the second crosslinking agent. That is, at this interface, the rate of gelation of the coating liquid for the formation of an ink-receiving layer or the rate of crosslinking increases.

The action of the above stepwise surface treatment has the following advantages. In the process of a first surface treatment on the substrate, the coating liquid is dried. Thus, boric acid or borate (hereinafter, referred to as "borate or the like") is located as a solid on the surface of a substrate or in the undercoating layer (the upper portion inside the layer). Furthermore, under such conditions, when the second surface treatment and the formation of the ink-receiving layer are performed, there is an advantage in that in an aqueous solution of boric acid or borate (hereinafter also referred to as "a borate-treating liquid or the like") applied in the process of the second surface treatment, mainly the borate-treating liquid or the like, securely realizes a liquid surface. Therefore, it becomes possible to ensure the liquid-to-liquid contact-mixing between a coating liquid for an ink-receiving layer in the subsequent step and the borate-treating liquid or the like applied in the process of the second surface treatment.

With the adoption of such a surface treatment including the above two processes, the substrate on which the solid of the borate or the like is present can be formed while making a wet state thereof by a borate-treating solution or the like more stably. A rapid crosslinking reaction can be obtained on the undercoating layer at the liquid-to-liquid contact interface, so that a solvent such as water in the coating liquid that forms an ink-receiving layer can be removed while separating it from the binder through pores formed in porous members to be formed. Therefore, an appropriate binding can be formed uniformly by an ideal aggregation of the pigments and the existence of the binder. As a result, the generation of cracks by the deficiency of the binder upon manufacturing can be prevented, and the formation of a thick ink-receiving layer with a large dry-coating amount becomes possible.

The above boric acid and borate to be used in the process of the second surface treatment may be the same one used at the time of forming the ink-receiving layer described above or one used in the process of the first surface treatment. Among them, however, it is preferable to use borax particularly in terms of, for example, the rate of gelation or the rate of crosslinking at the stage of forming the ink-receiving layer; variations in viscosity of the coating liquid for the ink-receiving layer to be caused during the usage; and the effects on the ink-receiving layer formed to prevent the generation of cracks in such a layer. In the process of the second surface treatment, it is preferable to adopt such a coating amount for the substrate after the first surface treatment as to avoid the overflow of the coating liquid. Although depending on the absorbency of the substrate after the first surface treatment, when the coating liquid of the second surface treatment is excessively overflowed, there is a possibility of floating the coating liquid for the ink-receiving layer as the coating liquid used in the second surface treatment is overflowed at the time of applying the coating liquid for the ink-receiving layer. As a result, in some cases, the adherence of the ink-receiving layer to the substrate decreases, so that the amount is preferably adjusted.

Furthermore, in the process of the second surface treatment, it is preferable to adjust the solid content concentration of at least one selected from the group consisting of boric acid and borate such that the dry-coating amount of the selected one is in the range of 0.05 to 2.0 g/m$^2$ in terms of the solid borax. In the process of the second surface treatment, the coating liquid that contains at least one selected from the group consisting of boric acid and borate, such as a 5%-borax aqueous solution is used. In addition, the 5%-borax aqueous solution is then applied on an undercoating layer after the first surface treatment. Furthermore, if required, the coating liquid may additionally contain a solvent such as alcohol for debubbling.

Furthermore, the dry-coating amount of the coating liquid to be applied in each of the first and second surface treatments can be appropriately determined on the basis of the relation between the first and second surface treatments. For instance, when the coating amount of the coating liquid is reduced in the process of the first surface treatment, it can be complemented with an increased coating amount of the coating liquid in the process of the second surface treatment. In consideration of the easiness of controlling the coating amount of the coating liquid and the relation to the coating amount of the coating liquid in the subsequent process of the second surface treatment, the dry-coating amount of the coating liquid in the process of the first surface treatment is defined to be in the range of 0.1 to 1.0 g/m$^2$. In consideration of the coating rate and the relation to the coating amount of the coating liquid in the first surface treatment, it is preferable that the dry-coating amount of the coating liquid in the process of the second surface treatment is in the range of 0.3 to 1.5 g/m$^2$. The wet surface described above is not provided as an even surface and has a recessed portion for the coating liquid. The adherence of the ink-receiving layer to the substrate and the anchoring effect can be ensured by generating a crosslinking of the binder in the recessed portion. Thus, it is configured to have the binder cross-linked in the recessed portion, so that it also can be an effective configuration for the resulting recording medium. In the preparation of the coating liquid for the ink-receiving layer, it is preferable to use a mixing device. Using such a mixing device, at least one selected from the group consisting of boric acid and borate is mixed with an alumina-hydrate-dispersing solution, and then the resulting mixture is further mixed with an aqueous solution of polyvinyl alcohol as a binder just before the coating to provide a coating liquid. Consequently, it becomes possible to decrease the degree of gelation and to minimize an increase with time in the viscosity of the coating liquid to be generated in the manufacturing process, so that an increase in production efficiency can be realized. The solid content of the pigment in the alumina-hydrate-dispersing solution to be used in the above case may be preferably in the range of 10 to 30% by mass. If it is higher than the above range, the viscosity of the pigment-dispersing solution increases and an increase in the viscosity of the ink-receiving layer is also observed. Therefore, problems may be caused in the coating ability of the coating liquid.

In an embodiment of the ink-receiving layer, as the configuration of the ink-receiving layer, the binder that constitutes such layer can be appropriately arranged for the pigment. Thus, pores can be uniformly distributed by the binder and the pigment which are provided by the coating liquid. Simultaneously, a substantial barrier-layer region that prevents loss of the binder provided by the coating liquid is formed under the conditions of high-speed and high-probability reaction at the liquid-to-liquid contact interface, so that the degree of crosslinking itself can be increased. It is particularly preferable that the above recording medium may have a porous substrate for supporting the above ink-receiving layer. In other words, it may be made of a porous member (e.g., paper, pulp, or porous layer) that allows the penetration of liquid components of the coating liquid, because, for removing a solvent in the coating liquid efficiently, it is preferable to eliminate liquid components such as a solvent for dissolving the binder in the coating liquid (e.g., the solvent may be water for dissolving PVA, preferably pure water for a countermeasure against contaminant to alumina) from the coating liquid at the time of the above crosslinking reaction.

In the undercoating layer described below and the ink-receiving layer described above, if required, other additives may be appropriately contained. Such other additives include a pigment dispersant, a thickening agent, a fluidity-improving agent, an anti-foaming agent, a foam inhibitor, a mold release agent, a penetrating agent, a coloring pigment, a coloring dye, a fluorescent brightening agent, a UV absorber, an antioxidant, an antiseptic agent, a fungicide, a waterproofing additive, a dye-fixing agent, and so on.

The inventors of the present invention have considered that the formation of an ink-receiving layer in a recording medium may be caused by the following events. At first, for example, by the reaction between boric acid or borate to be used in the surface treatment on the substrate and polyvinyl alcohol in the coating liquid for the ink-receiving layer (i.e., the gelation and/or the crosslinking reaction), (1) the binder in the ink-receiving layer may be distributed in a comparatively uniform manner due to the controlled penetration of the polyvinyl alcohol to the undercoating layer. Furthermore, in the step of drying the coating liquid at the time of forming the ink-receiving layer, (2) the viscosity of the coating layer may increase as the gelation and/or the crosslinking reaction may occur, so that the movement of the coating liquid may be suppressed. In particular, in the case of using alumina hydrate in the materials for forming an ink-receiving layer, the inventors of the present invention have inferred that a crosslinking reaction between alumina hydrate and boric acid or borate should cause a so-called inorganic polymer, and an interaction between boric acid or borate and alumina hydrate and polyvinyl alcohol acts to inhibit the generation of cracks in the ink-receiving layer.

The substrate to be used in the present invention may be one capable of being subjected to a surface treatment described below. For example, although not specifically limited, a fibrous substrate (i.e., a paper substrate) is preferable in the cases of subjecting the recording medium surface to the casting process and forming a glossy surface because water and solvent components are vaporized from the back side of the substrate. Examples of such a paper substrate include those prepared by processing original paper with starch, polyvinyl alcohol, or the like by means of size press, or other coating, paper such as art paper, coated paper, and cast-coated paper prepared by making coating layers on the respective original paper.

In the case of forming a glossy surface on the ink recording medium by subjecting the surface of the recording medium to the casting process, it is preferable to provide the surface of a paper substrate with a coating layer as an undercoating layer of an ink-receiving layer. In this case, the coating layer has a thickness large enough to completely cover cellulose pulp fibers or the texture formation thereof of the paper substrate (original paper). If it is not covered with such a coating layer, an uneven coating (streak-like defect or the like) due to the fibers or the texture formation of the paper substrate tends to be generated in the coating step to form an ink-receiving layer. In this case, cellulose pulp fibers are present in the ink-receiving layer, or in the vicinity of the surface of the ink-receiving layer, or on the surface of the ink-receiving layer. Thus, even if the surface of the ink recording medium is subjected to the casting process, an excellent and uniform cast surface, i.e., a photo-grade and high-glossy surface can be hardly obtained. For covering the cellulose pulp of the paper substrate, it is preferable that the coating layer has a dry-coating amount of 10 g/m$^2$ or more, more preferably 15 g/m$^2$ more. If the dry-coating amount is less than 10 g/m$^2$, it becomes difficult to completely cover the cellulose pulp fibers and the formation of the substrate, so that the glossiness of the recording medium may be affected.

The undercoating layer can be prepared by a coating liquid that contains well-known pigments and binders. Preferably, the undercoating layer may have ink-receiving property. One or more undercoating layers may be formed on at least one side of the substrate. Considering the stability of an environmental curl of the ink recording medium, the undercoating layer may be preferably formed on both opposite sides of the substrate. The substrate to be used in the present invention may be a paper substrate on which the above undercoating layer is formed. The air permeability of the substrate, which can be measured on the basis of JIS P 8117, is preferably in the range of 1,500 to 5,000 seconds in consideration of: evaporation of water and solvent components from the back side of the substrate in the casting process; the coating property (the wettability) of the coating liquid to be applied on the substrate and the coating property of a material for forming an ink-receiving layer to be formed on the substrate in the first and second surface treatments as described below; and so on. If the air-permeability is below the above range, the denseness of the substrate is low. Thus, the penetration of a crosslinking agent (boric acid or borate in the coating liquid) is high in the first and second surface treatments as described below, so that all of the crosslinking agents may not act thereon effectively. Alternatively, a larger coating amount is required. In addition, in the process of the second surface treatment, it is preferable to adopt such a coating amount as to avoid the overflow of the coating liquid. However, it is difficult to adjust the coating amount. It becomes difficult to make a stable coating with time in the whole CD/MD directions.

On the other hand, if the air-permeability of the substrate exceeds the above range, the penetrating property of the coating liquid to be applied in the first and second surface treatments described below is low. In this case, when the coating liquid for the ink-receiving layer is applied on the substrate, the coating liquid for the ink-receiving layer may be floated as a result of the overflow of the coating liquid used in the second surface treatment, or cracks may be generated in the resulting ink-receiving layer even though the amount of such cracks is small. Furthermore, at the time of casting, water and solvent components are hardly evaporated from the back side of the substrate. Thus, a good glossy surface may be hardly obtained. For the same reasons, the substrate may preferably have a Stöckigt sizing degree of 100 to 400 seconds, and a Bekk smoothness of 100 to 500 seconds. For obtaining a recording medium having the same high quality as that of a silver salt photograph, a basis weight of the substrate may be preferably in the range of 160 to 230 g/m$^2$ with a Gurley stiffness (J. Tappi No. 40, long grain) of 7 to 15 mN.

Here, materials used for the formation of an ink-receiving layer to be used in the present invention will be described. The ink-receiving layer can be formed by applying a coating liquid that contains a pigment and a binder. It is preferable that the pigment may contain, in particular, alumina hydrate as a main component in terms of dye fixability, transparency, printing density, color development, and glossiness. Alternatively, the following pigments may be used. For instance, inorganic pigments include light calcium carbonate, heavy calcium carbonate, magnesium carbonate, kaolin, aluminum silicate, diatomaceous earth, calcium silicate, magnesium silicate, synthetic amorphous silica, colloidal silica, alumina, magnesium hydroxide, and so on. In addition, organic pigments include styrene plastics pigment, acrylic plastics pigment, polyethylene particle, microcapsule particle, urea resin particle, melamine resin particle, and so on. These materials may be employed singly or in a combination of two or more kinds selected according to the necessity.

As the alumina hydrate, for example, one represented by the following general formula (1) may be preferably used.

$$Al_2O_3\text{-}n(OH)_{2n}.mH_2O$$

(wherein, n denotes any one of 0, 1, 2, and 3, m denotes a value within 0 to 10, preferably 0 to 5, but m and n are not simultaneously set to 0. In many cases, $mH_2O$ represents a removable water phase not related to the formation of a crystal lattice, so that m is an integer number or is a number other than an integer. Alternatively, m may reach the value of 0 when this kind of the material is heated).

The alumina hydrate can be generally prepared, for example, by one of the method of hydrolyzing aluminum alkoxide or hydrolyzing sodium aluminate as described in U.S. Pat. Nos. 4,242,271 B and 4,202,870 B, and the method of neutralizing by adding an aqueous solution such as aluminum sulfate or aluminum chloride into an aqueous solution of sodium aluminate as described in Japanese Patent Publication No. S57-44605. A preferable alumina hydrate to be used in the present invention is aluminum hydrate exhibiting a boehmite structure or an amorphous structure by an analysis using an X-ray diffraction method. In particular, aluminum hydrate described in Japanese Patent Application Laid-Open Nos. H07-232473, H08-132731, H09-66664, H09-76628, and so on may be used.

In the case of performing a casting process by making the ink-receiving layer into a wet condition by means of a rewet method for making the surface of the ink recording medium glossy, a plate-like alumina hydrate having the tendency of being oriented may be preferably used. The plate-like alumina hydrate has good water absorbency, so that a re-wetting liquid easily tends to penetrate. Thus, the ink-receiving layer becomes swollen to easily cause the rearrangement of alumina hydrate particles. As a result, high glossy properties can be attained. In addition, a re-wetting solution can effectively penetrate. Thus, the productive efficiency increases at the time of casting.

In the present invention, polyvinyl alcohol is used for the binder which is used in the coating liquid for the ink-receiving layer. The content of the polyvinyl alcohol may be preferably in the range of 5 to 20% by mass with respect to alumina hydrate. In the present invention, the binder to be used in the formation of the ink-receiving layer may be a conventional binder to be used in combination with the above polyvinyl alcohol.

In the material for the formation of the ink-receiving layer to be descried above, it is extremely effective for the formation of the ink-receiving layer to contain at least one selected from the group consisting of boric acid and borate. The borates which can be used in this case include not only orthoboric acid ($H_3BO_3$) but also meta-boric acid, and diboric acid. In addition, it is preferable that the borate may be an aqueous salt of the above boric acid. More specifically, the borates include, for example, alkali metal salts such as Na-salts of boric acid (e.g., $Na_2B_4O_710H_2O$ and $NaBO_2.4H_2O$) and potassium salts (e.g., $K_2B_4O_7.5H_2O$ and $KBO_2$), ammonium salts of boric acid (e.g., $NH_4B_4O_9.3H_2O$ and $NH_4BO_2$), and alkaline earth metal salts such as the magnesium salts of boric acid and calcium salts of boric acid.

In terms of the stability of the coating liquid with time and the inhibition effect on the generation of cracks, ortho-boric acid is preferably used. In addition, the amount of the ortho-boric acid to use is preferably in the range of 1.0 to 15.0% by mass (the solid content of boric acid) with respect to the polyvinyl alcohol in the ink-receiving layer. In this range, however, cracking may sometimes occur depending on the manufacturing conditions or the like, so that there is a need for selecting the manufacturing conditions. In addition, if the value is higher than the above range, it is not preferable because the stability of the coating liquid with time decreases. That is, the coating liquid is used for a long time during the manufacture. If the content of boric acid is high, an increase in viscosity of the coating liquid, or the generation of a gelated production can occur during the manufacture. Therefore, it becomes necessary to frequently exchange the coating liquid with a new one, cleaning a coater head, or the like. As a result, productivity can be notably decreased. Furthermore, if the value exceeds the above range, due to the same reasons as those of the first and second surface treatments, dot-like surface (cast surface) defects tend to occur in the casting process, so that a uniform and excellent glossy surface may not be obtained.

The ink-receiving layer formed as described above attains the objects and effects with respect to high ink absorbency and high fixing property when the pore physical properties satisfy the following conditions. At first, the pore volume of the ink-receiving layer is preferably in the range of 0.1 to 1.0 $cm^3/g$. That is, if the pore volume does not satisfy the above range, a sufficient ink absorbing property cannot be obtained, which results in an ink-receiving layer having poor ink absorbency. As the case may be, there is a possibility of causing the overflow of ink and the generation of bleeding in an image. On the other had, when it is above such a range, there is a tendency of causing cracks and powder falling in the ink-receiving layer. In addition, preferably, the ink receiving layer may have a BET specific surface area of 20 to 450 $m^2/g$. If it is below the above range, sufficient glossiness may not be acquired and haze increases (transparency falls), so that there is a possibility that white mist may be on an image. In this case, furthermore, there is also a possibility of causing a decrease in adherence of the dye in the ink undesirably. On the other hand, if the above range is exceeded, it is not preferable because cracks are easily generated in the ink-receiving layer. Furthermore, the pore volume and the BET specific surface area are calculated by the nitrogen adsorption and desorption method.

Furthermore, in the case of forming the ink-receiving layer, the application of the manufacturing method of the present invention allows an increase in the degree of freedom compared with the conventional one with respect to the thickness of the ink-receiving layer. In other words, it becomes possible to increase the thickness more than before. Considering a high ink absorbency, the amount of dry coating is preferably 30 $g/m^2$ or higher, and more preferably the upper limit thereof is 50 $g/m^2$. If it is below 30 $g/m^2$, in particular, a sufficient ink absorbency cannot be attained when a printer such as one having a plurality of light color inks in addition to black ink and three colors of cyan, magenta, and yellow. That is, it is not preferable because the overflow of ink may be generated and sometimes bleeding may occur. In this case, furthermore, the ink dye may be dispersed up to the substrate, and the printing density may be decreased. On the other hand, if it exceeds 50 $g/m^2$, there is a fear that the development of cracks cannot be absolutely avoided. Furthermore, if the value is larger than 30 $g/m^2$ it is preferable in that the ink-receiving layer shows a sufficient ink absorbency even under high-temperature and high-humidity circumstances. If the dry-coating amount is 50 $g/m^2$ or less, it becomes difficult to cause an uneven coating, so that the ink-receiving layer having a stable thickness can be obtained, which is more preferable. For forming an ink-receiving layer, a process with one coat and drying, a process with plural coats to obtain a total dry coating amount or the like can be employed. In the case of a process with two coats, for example, a dry coating amount of 20 $g/m^2$ is obtained with a first coat and drying, and another dry coating amount of 20 $g/m^2$ is obtained with a second coat and drying, thereby forming an ink-receiving layer having a dry coating amount of 40 $g/m^2$. Applying the method of applying a colorant deterioration preventing agent according to the present invention also to the ink-receiving layer formed by plural coats can obtain the objective concentration distribution of the colorant deterioration preventing agent in the direction of depth.

Boric acid or borate, which is contained in a coating liquid to be used in the process of the first or second surface treatment of the present invention, is the same one as that used for the material for forming the ink-receiving layer. In particular, in terms of prevention of the generation of cracks, it is preferable to contain sodium tetraborate (borax).

Coating of each coating liquid for the above ink-receiving layer and the surface treatment step is performed for obtaining an appropriate coating amount as described above, for instance, by appropriately selecting the device from among various kinds of coating devices including various blade coaters, roll coaters, air knife coaters, bar coaters, rod blade coaters, curtain coaters, gravure coaters, coaters using an extrusion method, coaters using a slide hopper method, and size press coaters, through on-machine or off-machine coating. At the time of coating, for adjusting the viscosity or the like of the coating liquid, the coating liquid may be heated, or the coater head may be heated.

For drying after the coating, for example, a hot air drier such as a linear tunnel drier, an arch drier, an air-loop drier, and a sine-curve air float drier, and also a drier such as a drier using infrared rays, a heating drier, and a drier using a microwave can be suitably chosen and used.

In the following, there will be explained an embodiment relating to the external addition method of the colorant deterioration preventing agent.

In the following, a colorant deterioration preventing agent to be employed in the present invention will be explained. The colorant deterioration preventing agent in the present invention means a compound, when present together with a dye in the ink-receiving layer, capable of protecting the dye from factors which deteriorate the dye such as gas and light, thereby improving the weather resistance of the dye. General examples include a hindered amine compound, a hindered phenol compound, a benzophenone compound, a benzotriazole compound, a thiourea compound, a thiuram compound and a phosphrous ester compound but these examples are not restrictive.

Among such colorant deterioration preventing agents, a hindered amine compound is particularly preferable in light fastness, moisture resistance, water resistance etc.

The hindered amine compound is preferably a compound having at least one hindered amine structure represented by the following general formula (1) within the molecule.

(I)

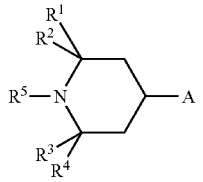

wherein $R^1$ to $R^4$ each independently represent a lower alkyl group with 1 to 5 carbon atoms, particularly preferably a methyl group or an ethyl group; $R^5$ is not particularly restricted and represents a hydrogen atom, a lower alkyl group, a benzyl group, an allyl group, an acetyl group, an alkoxyl group or a benzyloxy group; and A is not particularly restricted and represents an alkyl group, an alkoxyl group, an amino group, an amide group, a carboxyl group etc. Also A may represent an ester group of a dicarboxylic acid such as malonic acid, adipic acid, succinic acid, cebacic acid, maleic acid or phthalic acid, or an ester group of a tricarboxylic acid or a tetracarboxylic acid, or a group connecting to another hindered amine structure. Furthermore, A may be a group including a vinyl group, such as a (meth)acrylester group, in which case it may be a polymer having a hindered amine structure in a side chain.

An organic solvent for solving the colorant deterioration preventing agent of the present invention is not particularly restricted, and can be, for example, an ester such as ethyl acetate, or butyl acetate, a ketone such as methylisobutyl ketone, methylethyl ketone or acetone, an ether such as diethyl ether or ethyl methyl ether, or an alcohol such as isopropanol, methanol or ethanol. When applying a coating liquid containing the colorant deterioration preventing agent to the ink-receiving layer and subsequently conducting a rapid drying treatment, such a solvent as to effectively evaporate to give the objective distribution of the colorant deterioration preventing agent in the direction of depth according to the present invention is properly selected. For example, such a solvent that such effect of the present invention can be achieved at a high temperature of 80° C. or higher, preferably in the range of 80° C. to 180° C., is preferable and can be selected in consideration of the type of colorant deterioration preventing agents to be used.

In the present invention, the external addition of the colorant deterioration preventing agent to the ink recording medium can be achieved by completely dissolving the colorant deterioration preventing agent in at least one organic solvent to obtain a colorant deterioration preventing agent solution and applying a coat of such solution on the formed ink-receiving layer. A solid concentration of the colorant deterioration preventing agent within a range of 0.5 to 30 mass % is easy for coating. In consideration of the appearance of the ink recording medium after the finishing, the coating method for the colorant deterioration preventing agent is preferably a non-contact coating method with respect to the surface of the ink-receiving layer, for example with a die coater, an air-knife coater or a spray coater, but such method is not restrictive and there can also be employed a contact coating method such as with a roll coater, a bar coater or a gravure coater.

It is important to move to a drying step within a short time period before the applied colorant deterioration preventing agent completes penetration. It is preferable to move to a drying step after application within 10 seconds, more preferably within 5 seconds. A time period from the start to the completion of the drying process is preferably within 1 minute, more preferably within 30 seconds. The amount of drying air may be controlled for efficient drying.

In the ink-receiving layer, the colorant deterioration preventing agent preferably has a content within a range of 0.5 to 10 mass % with respect to the pigment solid. A sufficient suppressing effect for fading can be obtained with a content equal to or higher than the lower limit mentioned above. It is also possible to prevent a loss in the ink absorbing property with a content equal to or lower than the upper limit mentioned above.

The recording material of the present invention preferably has, as shown in FIGS. 3A and 3B, two regions with different concentrations of the colorant deterioration preventing agent within a range of 30 μm in the direction of depth from the recording surface of the ink-receiving layer, and, among these regions, a high concentration region with a higher concentration of the colorant deterioration preventing agent is positioned closer to the recording surface in the direction of depth of the ink-receiving layer than a low concentration region with a lower concentration of the colorant deterioration preventing agent. In this manner, the effect of the colorant deterioration preventing agent can be fully exploited. More preferably, the colorant deterioration preventing agent has a distribution of concentration gradually decreasing from the side of the recording surface of the ink-receiving layer. Such configuration exhibits a higher effect since the colorant deterioration preventing agent is present matching the penetration of the dye. The colorant deterioration preventing agent particularly preferably has a distribution of decreasing concentration in the direction of depth from the recording surface, within a range of a depth of 15 μm from the recording surface of the ink-receiving layer. More preferably, in an arbitrarily selected 10 μm thick region within such upper range of a depth of 15 μm from the recording surface, there is always a concentration distribution in which the concentration of the colorant deterioration preventing agent decreases in the direction of depth. For example, in any one of regions between the surface and 10 μm deep, between 3 μm deep and 13 μm deep and between 5 μm deep and 15 μm deep, there is a concentration distribution in which the concentration of the colorant deterioration preventing agent decreases in the direction of depth. Further preferably, in an arbitrarily selected 5 μm thick region within such upper range of a depth of 15 μm from the recording surface, there is always a concentration distribution in which the concentration of the colorant deterioration preventing agent decreases in the direction of depth. For example, in any one of regions between the surface and 5 μm deep, between 3 μm deep and 8 μm deep and between 10 μm deep and 15 μm deep, there is a concentration distribution in which the concentration of the colorant deterioration preventing agent decreases in the direction of depth.

The decreasing rate of the concentration in the arbitrarily selected regions is so selected as to be higher than the decreasing rate in the same depth range in a region beyond 15 μm deep.

The decrease may be stepwise or continuous. A concentration of the colorant deterioration preventing agent in a highest concentration region is preferably 1.5 times or more of a concentration of the colorant deterioration preventing agent in a lowest concentration region. In case the difference in the concentration is less than 1.5 times, the desired effect cannot be obtained as a proportion of the non-effective colorant deterioration preventing agent increases. It is more preferable that such concentration difference is present within a range of 15 μm in the direction of depth from the recording surface of the ink-receiving layer.

After forming the ink-receiving layer as described above, a glossy surface can be formed on the surface of the ink-receiving layer using the casting method. Such a forming method will be described below. The casting method is a method that includes pressing the ink-receiving layer in a wet state or in a state of having plasticity onto a heated-mirror drum (cast drum) surface, drying the layer being pressed onto the drum surface, and copying the mirror surface of the drum onto the surface of the ink-receiving layer. Typically, there are three kinds of casting methods known in the art, i.e., a direct method, a rewet method (indirect method), and a solidifying method. Each of these casting methods can be used in the present invention. However, as described above, in the present invention, it is preferable to use alumina hydrate in the ink-receiving layer of the recording medium. In this case, particularly, high glossiness can be obtained using a rewet-casting method as the more preferable ones.

The method of manufacturing an ink recording medium of the present invention may further include the step of forming a back side layer on the back side of the substrate (the side opposite to the side on which an ink-receiving layer is formed) to form an ink recording medium having the back side layer. The formation of such a back side layer is effective to reduce the generation of curl before or after printing.

Considering the effect of inhibiting the generation of curl, it is preferable that the back side layer may exhibit shrinkage similar to the undercoating layer formed on the substrate surface side and/or the ink-receiving layer upon the moisture-absorption. These layers may be used together with the pigment and the binder of the same system. In particular, it is preferable to use a pigment and a binder which are of the same system as the material for forming the thick ink-receiving layer. The formation of the back side layer may be performed before or after the first surface treatment, after the formation of the ink-receiving layer, or after the cast process.

Furthermore, in the process of manufacturing the ink recording medium of the present invention, if required, an additional layer such as the undercoating layer described above may be formed between the back side layer and the substrate. In this case, furthermore, a glossy surface may be also formed on the back side, to thereby obtain an ink recording medium having glossy surfaces on the opposite sides, respectively. In addition, if the printing performance is imparted to the back side layer, or the back side layer and/or another layer, double-sided printing can be performed.

Figure 7:
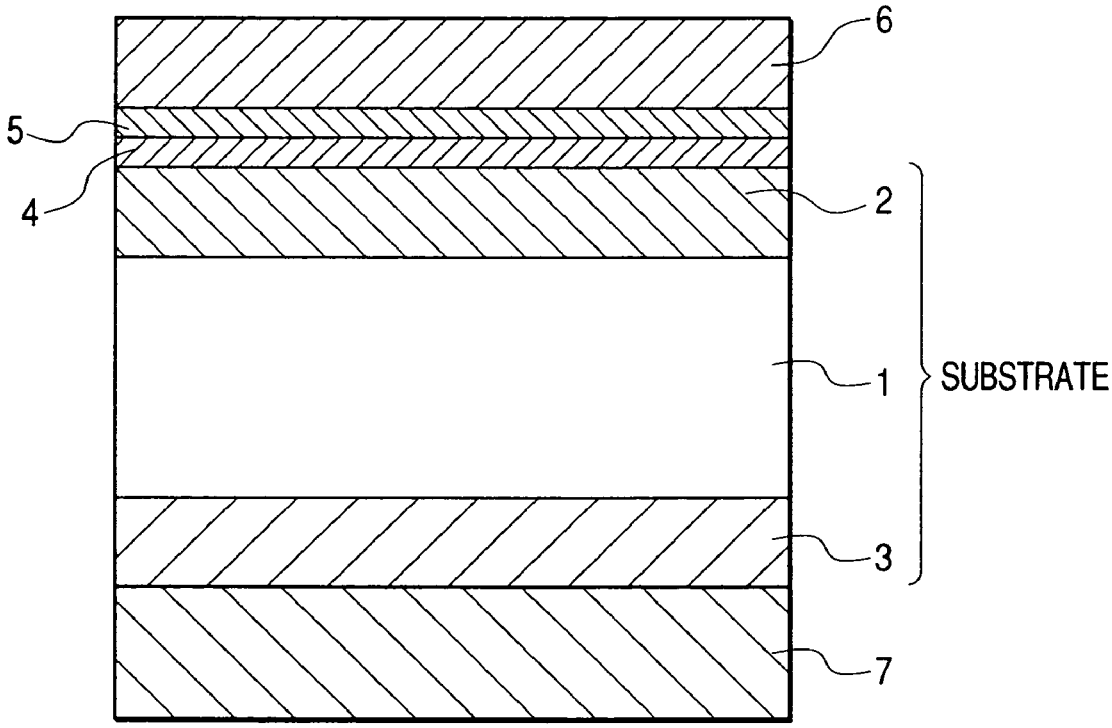
FIG. 7 is a view showing a configuration of an ink recording medium of the present invention.

Furthermore, the back side layer may be formed as follows. That is, for preventing the generation of cracks, as in the ink-receiving layer, the back side of the substrate is subjected to the first surface treatment, the second surface treatment, and the formation of the back side layer (i.e., the second surface treatment is performed after the first surface treatment). Subsequently, a coating liquid for the back side layer is applied while keeping the substrate in a wet state, followed by drying. However, in some cases (depending on the state of crack generation on the back side layer), it may be sufficient to perform only one of the first and second surface treatments. The configuration of the ink recording medium to be manufactured as described above is represented by a schematic cross-sectional diagram as shown in FIG. 7 as one of preferred embodiments. That is, the recording medium includes an original paper 1, an undercoating layer 2 containing a pigment, a binder, and so on, an undercoating layer 3, a surface treatment 4 by coating with a coating liquid containing borax and drying, a surface treatment 5 by coating with a coating liquid containing borax, an ink-receiving layer 6 (containing alumina hydrate, polyvinyl alcohol, boric acid, and so on) prepared through coating and drying while keeping the undercoating layer and the original paper in a wet state by the surface treatment, and a back side layer 7 containing a pigment and a binder.

EXAMPLES

Hereinafter, the present invention will be described in more detail based on examples and comparative examples. However, the present invention is not limited to those examples.

At first, a method of measuring various physical properties used in the present invention and a method of evaluating them will be explained.

(Stöckigt Sizing Degree)

The recording medium was cut into sheets in A4 size, and each of five sheets among them was left for 2 hours or more under the conditions of an atmospheric temperature of 23° C. and a humidity of 50%, and after that, based on JIS P8122, Stöckigt sizing degree was measured for every sheet, and was then calculated as the average of five sheets.

(Air Permeability)

Five sheets of the recording medium were left under the same conditions as those of the measurement of Stöckigt sizing degree. After that, the measurement of air permeability was conducted for every sheet according to JIS P8177. From the resulting values, the average value of five sheets was calculated.

(Bekk Smoothness)

Five sheets of the recording medium were left under the same conditions as those of the measurement of Stöckigt sizing degree. After that, the measurement of Bekk smoothness was conducted for every sheet according to JIS P8119. From the resulting values, the average value of five sheets was calculated.

(Gurley Stiffness)

Five sheets of the recording medium were left under the same conditions as those of the measurement of Stöckigt sizing degree. After that, the measurement of Gurley stiffness in the direction of long grain was conducted for every sheet according to J. Tappi No. 40. From the resulting values, the average value of five sheets was calculated.

(BET Specific Surface Area and Pore Volume)

After sufficiently carrying out the heat deaeration of the alumina hydrate, BET specific surface area and pore volume were measured using a device (Autosorb-1 (trade name) commercially available from Quantachrome Instruments) based on the nitrogen adsorption and desorption method. The BET specific surface area was calculated according to the method of Brunauer et al. (see J. Am. Chem. Soc., vol. 60., 309, 1938) The pore volume was calculated according to the method of Barrett et al. (see J. Am. Chem. Soc., vol. 73, 373, 1951).

(Glossiness)

According to JIS Z8741, relative-specular glossiness at 20° was measured using a gloss meter (trade name: VG2000, manufactured by Nippon Denshoku Kogyo, Co., Ltd.).

(Image Fastness)

Preparation of recorded sample: solid patches of a 100% duty of black, cyan, magenta and yellow were printed on the recording surface of each recording medium with an ink jet photo printer (trade name: PIXUS 950i, manufactured by Canon Inc.) and were used for testing.

<Ozone Test>

Ozone resistance was evaluated by measuring an image density of the aforementioned recorded sample before and after the test with a spectrophotometer Spectrino (manufactured by Gretag-Macbeth Inc.) and calculating a density retention rate according to the following equation:

Density retention rate (%)=image density after test/image density before test×100

The ozone resistance was evaluated according to the following criteria.

An image prepared as described above was subjected to a gas exposure test, utilizing an ozone exposure tester (manufactured by Suga Test Instruments Co.):

Test conditions ozone concentration: 2.0 ppm test time: 1.5 hours temperature-humidity conditions in test chamber: 23° C., 60% RH.

The gas resistance was evaluated according to the following criteria, based on the image density retention rate (%) after the ozone exposure test and on visual observation:

4: sample showing a density retention rate of 80% or higher in Bk density, and a density retention rate of 90% or higher in the other colors, and showing no change in the hue in comparison with that prior to the test.

3: sample showing a density retention rate of 70% or higher but less than 80% in Bk density, or a density retention rate of 80% or higher but less than 90% in the other colors, and showing a slight change in the hue in comparison with that prior to the test (except samples ranked as "1" or "2").

2: sample showing a density retention rate less than 70% in Bk density, and a density retention rate of 70% or higher but less than 80% in the other colors, and showing a hue evidently different from that prior to the test (except samples ranked as "1").

1: sample showing a density retention rate less than 70% in all the colors, and showing a hue evidently different from that prior to the test.

(Second Ozone Test)

After the ozone test, the same sample was subjected again to a same ozone test, and the result was evaluated according to the above-explained criteria.

(Ink Absorbency)

Using a printer (trade name: BJF 900 manufactured by Canon hc.), each primary color of yellow, magenta, cyan, and black was printed to prepare a 100% print section of 3 cm square. In addition, each secondary color of red (a secondary color between 100% yellow and 100% magenta), blue (a secondary color between 100% magenta and 100% cyan), and green (a secondary color between 100% yellow and 100% cyan) was printed to prepare a 100% print section of 3 cm square. Then, each print section was visually examined by visual observation and feeling with a finger. The results were evaluated according to the following criteria.

4: Immediately after printing, ink does not adhere to a finger in any of the secondary color images.

3: Immediately after printing, there is an extremely small amount of ink being overflowed by the secondary color image. However, the ink is absorbed in a short period of time. In addition, no ink is adhered on a finger in any of the monochrome images immediately after printing.

2: Immediately after printing, there is a small amount of ink being overflowed by the secondary color image. However, the ink is absorbed even though it takes much time, compared with the evaluation 3. In addition, no ink is adhered on a finger in any of the monochrome images immediately after printing.

1: Immediately after printing, ink is adhered on a finger in all of the monochrome images.

Example 1

At first, a substrate was prepared as follows. In a pulp slurry having 80 parts by mass of laubholz (deciduous) bleached kraft pulp (LBKP) with a freeness of 450 ml CSF (Canadian Standard Freeness) and 20 parts by mass of a nadelholz (coniferous) bleached kraft pulp (NBKP) with a freeness of 480 ml CSF, 0.60 parts by mass of cationized starch, 10 parts by mass of heavy calcium carbonate, 15 parts by mass of light calcium carbonate, 0.10 parts by mass of alkylketene dimer, and 0.03 parts by mass of cationic polyacrylamide were added to prepare the pulp. Then, the pulp was milled with a Fourdrinier machine and was then subjected to a 3-stepped wet press, followed by drying with a multi-tube dryer. Then, the pulp was impregnated in a size press device with an aqueous solution of oxidized starch with a solid content of 1.0 g/m$^2$. After drying, machine calendering was carried out, resulting in a substrate having a basis weight of 155 g/m$^2$, a Stöckigt sizing degree of 100 seconds, an air permeability of 50 seconds, a Bekk smoothness of 30 seconds, and a Gurley stiffness of 11.0 mN.

Next, an undercoating layer was formed on the substrate as described above in the following manner. A coating liquid to be used for the formation of the under coating layer was prepared as a composition by adding 7 parts by mass of commercially-available styrene-butadiene latex in a slurry (70 mass % in solid content) having 100 parts by mass (loading weight) of kaolin (trade name: Ultra White 90, manufactured by Engelhard Co., Ltd.)/zinc oxide/aluminum hydroxide (at a weight ratio of 65/10/25) and 0.1 parts by mass of a commercially-available polyacrylic acid dispersant in such a manner that the resulting composition had a solid content of 60 mass %. Then, the composition was applied on both sides of the substrate using a blade coater so as to have a dry-coating amount of 15 g/m$^2$ and was then dried. Subsequently, the dried composition was subjected to a machine calendering (a linear load of 150 kgf/cm), resulting in a substrate having an undercoating layer and having a basis weight of 185 g/m$^2$, a Stöckigt sizing degree of 300 seconds, an air-permeability of 3,000 second, a Bekk smoothness of 200 seconds, and a Gurley stiffness of 11.5 mN. The Whiteness of the substrate having the undercoating layer was measured for each of five samples in A4 size prepared by cutting the substrate into sheets. Then, an average was obtained. As a result, L*: 95, a*: 0, b*: −2 was obtained (i.e., obtained as color hue of JIS Z 8729).

The undercoating layer obtained as described above was further subjected to a surface treatment including the following first and second steps. At first, in the first surface treatment step, a 5 mass % -borax aqueous solution warmed at 30° C. was used as a coating liquid. Then, the coating liquid was applied on the undercoating layer using a gravure coater at a rate of 60 m/m so as to attain a dry-coating amount of 0.4 g/m$^2$. After that, the coating liquid was dried and solidified at 60° C. Next, in the process of the second surface treatment, a coating liquid was prepared just as in the case of the process of the first surface treatment. Thus, a 5 mass %-borax aqueous solution heated at 30° C. was used as the coating liquid and was then applied on the undercoating layer using an air-knife coater at a rate of 30 meters per minute so as to attain a wet coating amount of 10 g/m$^2$ (0.5 g/m$^2$ when dried). According to the visual observation, the coating amount provided a state where the coating liquid applied in the second surface treatment did not overflow but was just impregnated.

Subsequently, an ink-receiving layer was formed. After the coating in the process of the second surface treatment, that is, immediately after the coating liquid was impregnated into the undercoating layer, an ink-receiving layer was immediately formed on the undercoating layer. In this case, the coating liquid and the coating method used for the formation of the ink-receiving layer were as follows.

As alumina hydrate A, Disperal HP13 (trade name, manufactured by Sasol Co., Ltd.) was dispersed in water (preferably, purified water as a countermeasure against contaminant to alumina) so as to be 5% by mass in solid content. Then, hydrochloric acid was added for adjusting pH to 4, and the mixture was stirred for a while. Then the resulting dispersion was heated up to 95° C. under agitation and was then kept at such a temperature for 4 hours. Subsequently, the dispersion was adjusted to pH 10 with caustic soda at the same temperature, followed by stirring for 10 hours. Then the dispersion was cooled to the room temperature and pH was then adjusted to 7 to 8. Furthermore, the dispersion was subjected to desalination, followed by an addition of acetic acid to allow a deflocculation to obtain a colloidal sol. The colloidal sol was dried to obtain alumina hydrate B. The alumina hydrate B was subjected to the measurement using an X-ray diffraction. As a result, it was revealed that the alumina hydrate B had a boehmite structure (pseudo boehmite). In addition, the BET specific surface areas at this time were 143 g/m$^2$, the pore volume was 0.8 cm$^3$/g, and it had a plate-like shape in observation with an electron microscope.

On the other hand, polyvinyl alcohol JM-23 (manufactured by Japan VAM & POVAL, Ltd.) was dissolved in water (preferably, purified water as a countermeasure against contaminant to alumina) to obtain an aqueous solution of 9% by mass of solid content. Then, the colloidal sol of alumina hydrate B prepared above was concentrated to prepare a dispersion of 22.5% by mass. Subsequently, a 3 mass %-boric acid aqueous solution was added in the dispersion so as to attain 0.50% by mass with respect to the solid content of the alumina hydrate B in terms of the solid content of boric acid. After that, the resulting alumina hydrate dispersion containing boric acid was mixed with a polyvinyl alcohol aqueous solution previously prepared by a static mixer such that the ratio of solid contents between alumina hydrate and polyvinyl alcohol becomes 100:8. Just after the mixing, it was provided as a coating liquid for the ink-receiving layer and was then applied with a dye coater at a rate of 30 meters per minute so as to attain a dry-coating amount of 35 g/m$^2$. Then it was dried at 170° C. to form an ink-receiving layer.

Next, a back side layer was formed on the undercoating layer on another side of the substrate, which was opposite to the ink-receiving layer. In this case, as alumina hydrate, Disperal HP13/2 (trade name, manufactured by Sasol Co., Ltd.) was dispersed in water (preferably, purified water as a countermeasure against contaminant to alumina) so as to have a solid content of 18% by mass, followed by centrifuging. The resulting dispersion and the same polyvinyl alcohol aqueous solution as one used in the formation of the ink receiving layer were mixed together with a static mixer such that the ratio between the alumina hydrate solid content and the polyvinyl alcohol content becomes 100:9. Immediately after mixing, the resulting coating liquid was applied by the dye coater at a rate of 35 meters per minute so as to attain a dry-coating amount of 23 g/m$^2$. Then, the coating liquid was dried at 170° C., and the back side layer is formed to obtain a recording medium of this example.

Difference in crosslinking degree between the first and second layer regions was estimated from the content of boron "B" in these layers. Here, for calculating the content of boron "B" in the first and second layer regions, the content of boron "B" in the first layer region was regarded as the content of boron "B" in the coating liquid used for forming the ink-receiving layer, while the content of boron "B" in the second layer region was regarded as the amount of boron "B" that penetrates into the second layer region or the content of boron "B" in the second surface treatment liquid. The content of boron "B" in the first layer region was $2.61\times10^{-3}$ mol/m$^2$, and also the content of boron "B" in the second layer region was $9.94\times10^{-3}$ mol/m$^2$. Thus, the content of boron "B" in the second layer region was 3.8 times of that of the first layer region. Furthermore, the content of boron "B" in the first layer region was calculated from the following equation.

(Dry-coating amount of ink-receiving layer:35)×(amount of boric acid: 22.5×0.5%)/{(amount of boric acid: 22.5×0.5%)+(amount of PVA: 22.5×8/100)+(amount of alumina hydrate: 22.5)}=0.16 g/m$^2$ 0.16/(molecular weight of 1 mol of boric acid: 61.8)=$2.61\times10^{-3}$ mol/m$^2$ In addition, the content of boron "B" in the second layer region was calculated from the following equation.

{(Dry-coating amount of the second surface treatment: 0.5)/(molecular weight of 1 mol of borax: 201.2)}×(number of moles of B per mole of borax: 4)=$9.94\times10^{-3}$ mol/m$^2$.

Here, the molecular weight of 1 mol of borax was calculated such that the borax was in a state of being impregnated with respect to the undercoating layer, that is, was not in a dry state and thus, borax was regarded as $Na_2B_4O_7$.

Then, on the thus-formed ink-receiving layer, a 5 mass % MIBK (methyl isobutyl ketone) solution of a hindered amine compound Adekastab LA-63P (manufactured by Asahi Denka Co.) shown in Table 1 was applied with a roll coater at a speed of 60 m/min, and an excess amount was scraped off with a Meyer bar to obtain a coating amount of 1.3 g/m$^2$ or an amount of 4 mass % with respect to the pigment solid. It was then dried at 110° C. for 20 seconds within 5 seconds after coating to obtain a desired ink recording medium.

TABLE 1

| Commercial Name | Chemical Structure |
|---|---|
| Adekastab LA-63P | 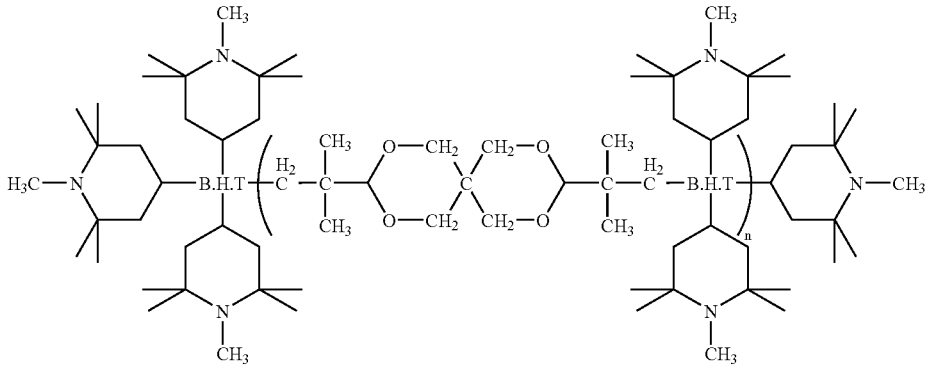 |
| | B.H.T: 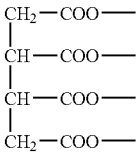 |
| Nocceler EUR | 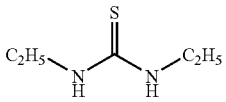 |
| Sumilizer MDP-9 | 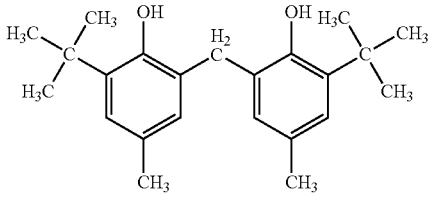 |

The concentration distribution of the hindered amine in the obtained ink recording medium was measured with the following method. A cross-sectional sample of the ink recording medium prepared with a microtome was used for the measurement.

Figure 8B:
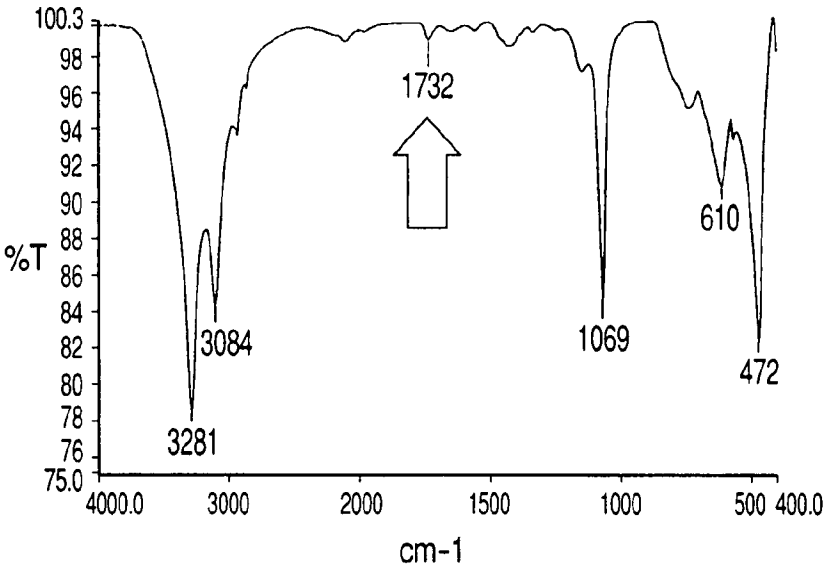
FIGS. 8A and 8B are charts showing an example of IR measurement results.
Figure 8A:
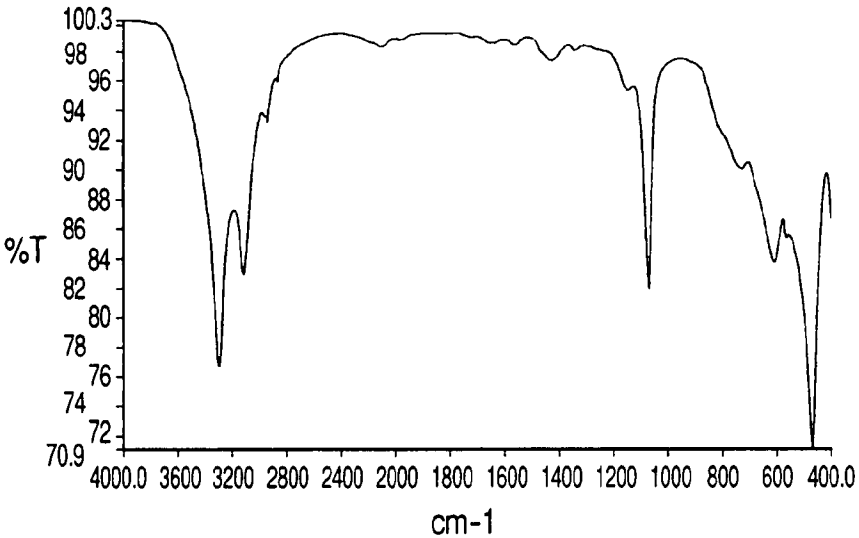

A line analysis by FT-IR microscopic transmissive measurement was conducted under the following conditions:

measuring instrument: Spectrum One (Perkin-Elmer Inc.)

aperture: rectangular 98×14 μm line analysis condition: 120 scan/step, 1 μm/step measured wavelength: 1730 cm$^{-1}$ (IR measurements before and after the external addition of hindered amine provided an absorption derived from the hindered amine that was not observed before the addition; cf. FIGS. 8A and 8B).

Figure 9:
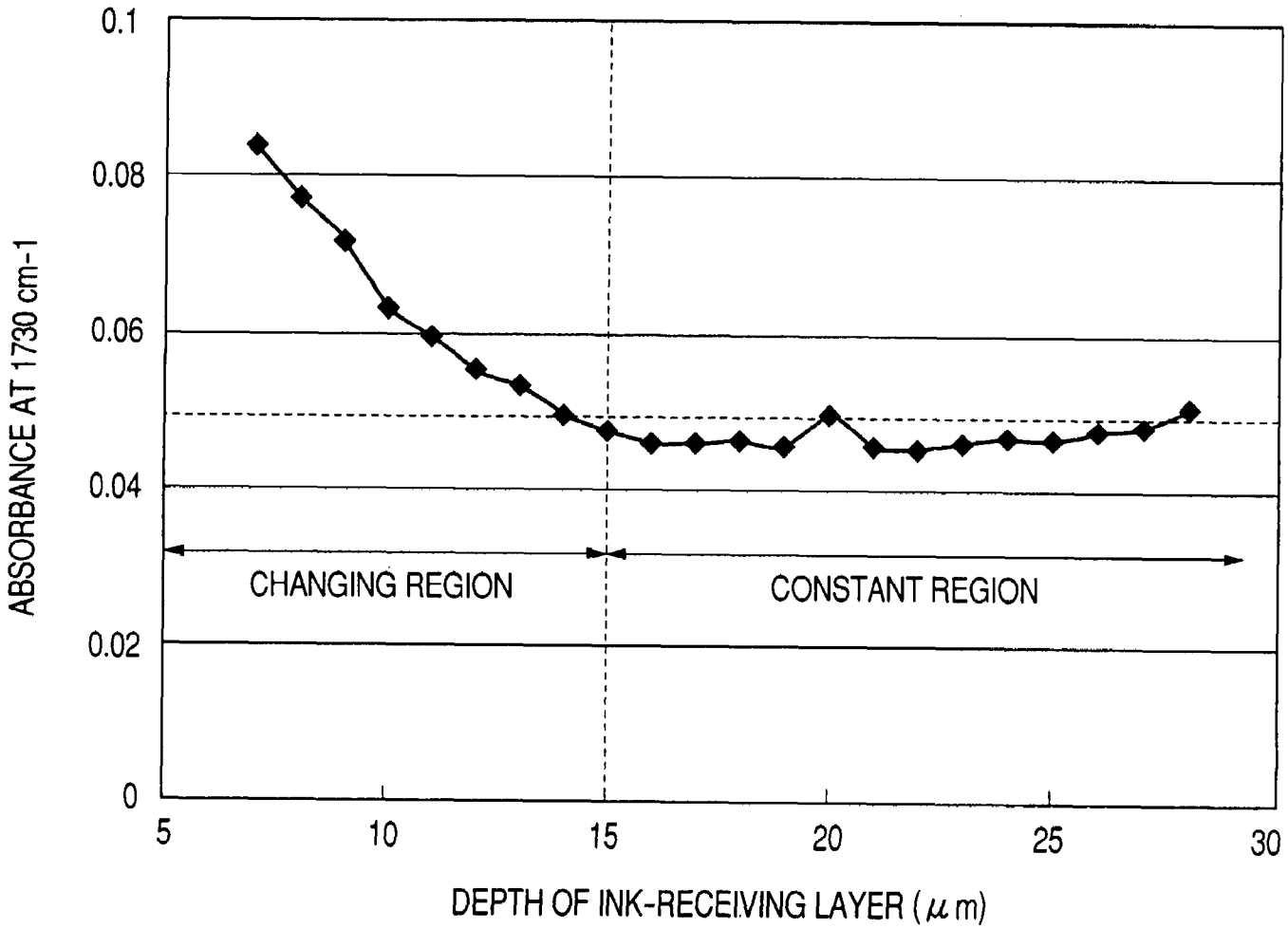
FIG. 9 is a chart showing a change in absorbance of a hindered amine compound in the direction of depth of an ink-receiving layer.

FIG. 9 shows an obtained change in absorbance of the hindered amine compound in the direction of depth of the ink-receiving layer. As the aperture of the measuring instrument had a size of 14 μm, the measurements were conducted with a width of 14 μm, starting from a position of a depth of 7 μm from the recording surface, and with displacements of 1 μm each in the direction of depth down to a position of a depth of 28 μm. It was found that the absorbance decreased with an increase in the depth. The change of the absorbance included a changing region showing a continuous decrease down to a depth of 15 μm, and a constant region deeper than 15 μm, showing a substantially constant absorbance. It is therefore possible, by forming a distribution of concentration within such range of 15 μm, to improve the absorption efficiency thereby enhancing the effect of the colorant deterioration preventing agent. Also, by forming the distribution of concentration within a range of 10 μm, the distribution can be made substantially steeper to obtain an ideal state of the absorption efficiency and the distribution of the colorant deterioration preventing agent, and the recording property is also further improved when the distribution of concentration is defined to be within a range of 15 μm. Also, an ideal state can be attained when the distribution of concentration is formed within a range of 5 μm in the direction of depth. Also, the maximum absorbance was about 1.8 times, the minimum absorbance. Therefore, it was identified that the highest concentration of the hindered amine was about 1.8 times the lowest concentration thereof. In this manner, a distribution in the concentration of the hindered amine compound was confirmed.

Example 2

An ink recording medium of this example was prepared in the same manner as in Example 1, except that the hindered amine compound was changed to a thiourea compound Nocceler EUR (manufactured by Ouchishinko Chemicals Co.) shown in Table 1. Also an IR measurement in the same manner as in Example 1 confirmed that the thiourea compound had a distribution of concentration similar to that in Example 1.

Example 3

An ink recording medium of this example was prepared in the same manner as in Example 1, except that the hindered amine compound was changed to a hindered phenol compound Sumilizer MDP-9 (manufactured by Sumitomo Chemical Co.) shown in Table 1. Also an IR measurement in the same manner as in Example 1 confirmed that the hindered phenol compound had a distribution of concentration similar to that in Example 1.

Example 4

An ink recording medium of this example was prepared in the same manner as in Example 1, except that the addition amount of the hindered amine compound was changed to 0.5 mass % with respect to the pigment solid. Also an IR measurement in the same manner as in Example 1 confirmed that the hindered amine compound had a distribution of concentration similar to that in Example 1.

Example 5

An ink recording medium of this example was prepared in the same manner as in Example 1, except that the addition amount of the hindered amine compound was changed to 10 mass % with respect to the pigment solid. Also an IR measurement in the same manner as in Example 1 confirmed that the hindered amine compound had a distribution of concentration similar to that in Example 1.

Example 6

The ink-receiving layer of Example 1 was given a glossy surface by the following rewet casting method. At first water as a rewetting liquid was uniformly applied to wet the ink-receiving layer, which in such wet state was pressed to a casting drum having a mirror surface heated to 100° C. and dried at a rate of 30 m/min, thereby obtaining an ink recording medium of this example. The surface of the ink-receiving layer had a glossiness of 32%. Also an IR measurement in the same manner as in Example 1 confirmed that the hindered amine compound had a distribution of concentration similar to that in Example 1.

Example 7

An ink recording medium of this example was prepared in the same manner as in Example 3, except that the step of external addition of hindered amine and the casting step were executed in an inverted order. The surface of the ink-receiving layer had a glossiness of 29%. Also an IR measurement in the same manner as in Example 1 confirmed that the hindered amine compound had a distribution of concentration similar to that in Example 1.

Example 8

An ink recording medium of this example was prepared in the same manner as in Example 1, except that a silica-containing ink-receiving layer was formed instead of the alumina-hydrate-containing ink-receiving layer in Example 1. A composition used for the coating liquid for the ink-receiving layer was 100 parts by mass of cationic colloidal silica of an average particle size of 80 nm (trade name: Snowtex AK-ZL, manufactured by Nissan Chemical Industries Ltd.), 3 parts by mass of a commercially available nonionic acryl emulsion, and 7 parts by mass of polyvinyl alcohol the same as in Example 1. The composition was adjusted to a solid concentration of 25 mass %, applied with a roller coater to obtain a dry coating amount of 30 g/m$^2$ and was dried. Other steps were executed in the same manner as in Example 1 to obtain a recording medium of the present example. Also an IR measurement in the same manner as in Example 1 confirmed that the hindered amine compound had a distribution of concentration similar to that in Example 1.

Example 9

A recording medium was prepared in the same manner as in Example 1, except that the first surface treatment step was not conducted and that the amount of the aqueous borax solution, used for the second surface treatment step, was changed to 5.2 g/m$^2$ in a wet coating amount. Thus, in this recording medium, the amount of boron B used in the second surface treatment step became $5.22\times10^{-3}$ mol/m$^2$. An IR measurement in the same manner as in Example 1 confirmed that the hindered amine compound had a distribution of concentration similar to that in Example 1. Also in such distribution of concentration, a highest concentration thereof was identified as 1.49 times of a lowest concentration.

Example 10

An ink recording medium was prepared in the same manner as in Example 1, except that both the first and second surface treatment steps were not executed. An IR measurement in the same manner as in Example 1 confirmed that the hindered amine compound had a distribution of concentration, in which a highest concentration was 1.40 times of a lowest concentration.

Comparative Example 1

An ink recording medium was prepared in the same manner as in Example 1, except that the hindered amine compound was not externally added.

Comparative Example 2

An ink recording medium was prepared in the same manner as in Example 1, except that both the first and second surface treatment steps were not executed and that the drying step was omitted after the application of the colorant deterioration preventing agent, which was instead dried spontaneously. An IR measurement in the same manner as in Example 1 showed an almost constant absorbance of about 0.05 over the entire thickness, indicating that the externally added hindered amine compound was uniformly dispersed.

Comparative Example 3

An ink recording medium was prepared in the same manner as in Example 1, except that the addition of the hindered amine compound was changed, from the application of an organic solvent employed in Example 1, to a method of mixing the following acidic treating liquid of the hindered amine compound into the coating liquid employed for forming the ink-receiving layer.

At first an acidic treating liquid of a hindered amine compound was prepared by employing an acid of 1.05 equivalents of a base amount of the hindered amine compound LA-63P (Asahi Denka Co.) in which the hindered amine compound represented 35 mass % of the entire amount. Then an ink recording medium was prepared in the same manner as in Example 1, except that the addition of the hindered amine compound was changed, from the application of an organic solvent employed in Example 1, to a method of mixing the aforementioned acidic treating liquid of the hindered amine compound into the coating liquid employed for forming the ink-receiving layer. The acidic treating liquid of the hindered amine compound was mixed under agitation into the coating liquid, employed for forming the ink-receiving layer, in such a manner that the solid of the hindered amine compound represented 4 mass % with respect to the solid of alumina hydrate, thereby obtaining a coating liquid.

An IR measurement in the same manner as in Example 1 proved that the hindered amine compound did not have a distribution of concentration and was uniformly dispersed in the ink-receiving layer.

Comparative Example 4

An ink recording medium was prepared in the same manner as in Comparative Example 3, except that the acidic treating liquid of hindered amine was replaced by a hindered amine emulsion LX-332 (manufactured by Asahi Denka Co.). An IR measurement in the same manner as in Example 1 proved that the hindered amine compound did not have a distribution of concentration and was dispersed uniformly.

Comparative Example 5

An ink recording medium was prepared in the same manner as in Comparative Example 2, except that the hindered amine compound was replaced by a 1:3 (mass ratio) mixture of a hindered phenol compound Sumilizer MDP-9 (manufactured by Sumitomo Chemicals, Ltd.) and a hindered amine LA-63P (manufactured by Asahi Denka Co.). An IR measurement in the same manner as in Example 1 proved that the hindered amine compound and the hindered phenol compound did not have a distribution of concentration and were dispersed uniformly.

Results of evaluation in "ozone test", "second ozone test" and "absorbency" in the foregoing examples and comparative examples are shown in Table 2.

TABLE 2

| | Example 1 | Example 2 | Example 3 | Example 4 | Example 5 |
|---|---|---|---|---|---|
| ozone test | 4 | 4 | 4 | 4 | 4 |
| second ozone test | 4 | 3 | 4 | 3 | 4 |
| absorbency | 4 | 4 | 4 | 4 | 3 |

TABLE 2-continued

| | Example 6 | Example 7 | Example 8 | Example 9 | Example 10 |
|---|---|---|---|---|---|
| ozone test | 4 | 4 | 4 | 4 | 4 |
| second ozone test | 4 | 4 | 4 | 3 | 2 |
| absorbency | 4 | 4 | 4 | 4 | 3 |
| | Comp. Example 1 | Comp. Example 2 | Comp. Example 3 | Comp. Example 4 | Comp. Example 5 |
| ozone test | 1 | 3 | 2 | 3 | 4 |
| second ozone test | 1 | 1 | 1 | 1 | 1 |
| absorbency | 4 | 2 | 3 | 3 | 2 |

What is claimed is:

1. An ink recording medium comprising:

an ink-receiving layer constituting a recording surface and containing a pigment for holding a colorant of an ink;

a binder for said pigment; and a colorant deterioration preventing agent, wherein said ink-receiving layer includes, within a range of 30 Φm in a direction of depth from the recording surface, a high concentration portion in which the concentration of said colorant deterioration preventing agent is relatively high and a low concentration portion in which the concentration of said colorant deterioration preventing agent is relatively low, and said colorant deterioration preventing agent has a concentration distribution continuously decreasing in the direction of depth from the recording surface from said high concentration portion to said low concentration portion, wherein said colorant deterioration preventing agent is a gas deterioration preventing agent, wherein said colorant deterioration preventing agent contained in said ink-receiving layer has a concentration in a maximum concentration portion of 1.5 times or higher of a concentration in a minimum concentration portion, wherein said binder is crosslinked, and wherein the crosslinking of said binder progresses with increasing depth from the recording surface of said ink-receiving layer.

2. The ink recording medium according to claim 1, wherein said ink-receiving layer contains said colorant deterioration preventing agent in an amount of 0.5 to 10 parts by mass with respect to 100 parts by mass of said pigment.

3. The ink recording medium according to claim 1, wherein said colorant deterioration preventing agent has a concentration distribution decreasing in the direction of depth from the recording surface, within a range of 15 Φm in the direction of depth from the recording surface of said ink-receiving layer.

4. The ink recording medium according to claim 3, wherein said colorant deterioration preventing agent has a concentration distribution decreasing in the direction of depth from the recording surface, within a range of arbitrarily selected 10 Φm in the direction of depth of said ink-receiving layer.

5. The ink recording medium according to claim 3, wherein said colorant deterioration preventing agent has a concentration distribution decreasing in a direction of depth from the recording surface, within a range of arbitrarily selected 5 Φm in the direction of depth of said ink-receiving layer.

6. The ink recording medium according to claim 1, wherein said ink-receiving layer is formed by a process comprising applying a coating liquid containing alumina hydrate as said pigment, polyvinyl alcohol as said binder and orthoboric acid as a crosslinking agent, on a wet surface containing a tetraborate salt.

7. The ink recording medium according to claim 1, wherein said colorant deterioration preventing agent is a hindered amine compound.

8. The ink recording medium according to claim 1, wherein said ink-receiving layer has a dry coating amount of 30 g/m$^2$ or higher.

9. The ink recording medium according to claim 1, wherein said ink-receiving layer is formed by a coating on an absorbent substrate.

10. A method for producing an ink recording medium including an ink-receiving layer constituting a recording surface and containing a pigment for holding a colorant of an ink, a binder for the pigment, and a colorant deterioration preventing agent, the method comprising:

forming an ink-receiving layer including, within a range of 30 Φm in a direction of depth from the recording surface of the ink-receiving layer, a high concentration region in which the concentration of said colorant deterioration preventing agent is relatively high and a low concentration region in which the concentration of said colorant deterioration preventing agent is relatively low, and the colorant deterioration preventing agent has a concentration distribution continuously decreasing in the direction of depth from the recording surface from the high concentration portion to the low concentration portion, wherein the colorant deterioration preventing agent is a gas deterioration preventing agent, wherein the colorant deterioration preventing agent contained in the ink-receiving layer has a concentration in a maximum concentration portion of 1.5 times or higher of a concentration in a minimum concentration portion, wherein the binder is crosslinked, and wherein the crosslinking of the binder progresses with increasing depth from the recording surface of the ink-receiving layer.

11. The method for producing an ink recording medium according to claim 10, wherein the pigment includes alumina hydrate and the ink-receiving layer has a dry coating amount of 30 g/m$^2$ or higher.

12. An ink recording medium comprising:

an ink-receiving layer constituting a recording surface and containing a pigment for holding a colorant of an ink;

a binder for said pigment; and a colorant deterioration preventing agent, wherein said ink-receiving layer is such that said colorant deterioration preventing agent within a range of 15 Φm in a direction of depth from the recording surface has a concentration distribution continuously decreasing in the direction of depth from the recording surface from a high concentration portion to a low concentration portion, wherein said colorant deterioration preventing agent is a gas deterioration preventing agent, wherein said colorant deterioration preventing agent contained in said ink-receiving layer has a concentration in a maximum concentration portion of 1.5 times or higher of a concentration in a minimum concentration portion, wherein said binder is crosslinked, and wherein the crosslinking of said binder progresses with increasing depth from the recording surface of said ink-receiving layer.

13. An ink recording medium comprising:

an ink-receiving layer constituting a recording surface and containing a pigment for holding a colorant of an ink;

a binder for said pigment; and a colorant deterioration preventing agent, wherein said ink-receiving layer includes, within a range of 30 Φm in a direction of depth from the recording surface, a high concentration portion in which the concentration of said colorant deterioration preventing agent is relatively high and a low concentration portion in which the concentration of said colorant deterioration preventing agent is relatively low, and said colorant deterioration preventing agent has a concentration distribution continuously decreasing in the direction of depth from the recording surface from said high concentration portion to said low concentration portion, wherein said ink-receiving layer has a dry coating amount of 30 g/m$^2$ or higher, wherein said colorant deterioration preventing agent is a hindered amine compound, wherein said colorant deterioration preventing agent is a gas deterioration preventing agent, wherein said colorant deterioration preventing agent contained in said ink-receiving layer has a concentration in a maximum concentration portion of 1.5 times or higher of a concentration in a minimum concentration portion, wherein said binder is crosslinked, and wherein the crosslinking of said binder progresses with increasing depth from the recording surface of said ink-receiving layer.

* * * * *